US006350022B1

(12) United States Patent
Takemura et al.

(10) Patent No.: US 6,350,022 B1
(45) **Date of Patent: *Feb. 26, 2002**

(54) INK JET RECORDING APPARATUS

(75) Inventors: Makoto Takemura, Irvine, CA (US); Tetsuhiro Nitta, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/521,272

(22) Filed: Aug. 31, 1995

(30) Foreign Application Priority Data

Sep. 2, 1994 (JP) ..... 6-210247
Sep. 2, 1994 (JP) ..... 6-210250

(51) Int. Cl.[7] ..... B41J 2/175; B41J 2/17

(52) U.S. Cl. ..... 347/85; 347/96

(58) Field of Search ..... 347/96, 100, 101, 347/98, 85, 86

(56) References Cited

U.S. PATENT DOCUMENTS

| | | | | | |
|---|---|---|---|---|---|
| 4,419,678 | A | | 12/1983 | Kasugayama et al. | 347/87 |
| 4,599,627 | A | | 7/1986 | Vollert | 346/140 R |
| 4,694,302 | A | | 9/1987 | Hackleman et al. | 346/1.1 |
| 4,760,409 | A | * | 7/1988 | Kiyohara et al. | 347/86 |
| 5,138,342 | A | | 8/1992 | Kurata et al. | 347/87 |
| 5,138,344 | A | | 8/1992 | Ujita | 347/86 |
| 5,155,502 | A | | 10/1992 | Kimura et al. | 347/50 |
| 5,182,581 | A | | 1/1993 | Kashimura et al. | 347/86 |
| 5,315,317 | A | | 5/1994 | Terasawa et al. | 347/7 |
| 5,430,471 | A | | 7/1995 | Nakajima et al. | 347/87 |
| 5,509,140 | A | * | 4/1996 | Koitabashi et al. | 347/86 |
| 5,549,740 | A | * | 8/1996 | Takahashi et al. | 347/100 |
| 5,555,008 | A | * | 9/1996 | Stoffel et al. | 347/100 |
| 5,635,969 | A | * | 6/1997 | Allen | 347/96 |
| 5,742,308 | A | * | 4/1998 | Cowger et al. | 347/85 |

FOREIGN PATENT DOCUMENTS

| | | | | |
|---|---|---|---|---|
| EP | 0412459 A2 | | 2/1991 | |
| EP | 0419876 A1 | | 4/1991 | |
| EP | 0488829 A2 | | 6/1992 | |
| EP | 0534635 A1 | | 3/1993 | |
| EP | 0587164 A2 | | 3/1994 | |
| EP | 0606022 A1 | | 12/1994 | |
| JP | 61-231284 | | 10/1986 | |
| JP | 61249755 | | 11/1986 | |
| JP | 63-299971 | * | 12/1988 | |
| JP | 63315284 | * | 12/1988 | 427/256 |
| JP | 01063185 | | 3/1989 | |
| JP | 02039213 | | 10/1990 | |
| JP | 4-173346 | | 6/1992 | |
| JP | 5-112015 | | 5/1993 | |
| JP | 5-202328 | | 8/1993 | |
| JP | 7-156538 | | 6/1995 | |

* cited by examiner

*Primary Examiner*—John Barlow
*Assistant Examiner*—Michael Brooke
(74) *Attorney, Agent, or Firm*—Fitzpatrick, Cella, Harper & Scinto

(57) ABSTRACT

A recording apparatus performs recording on a recording medium by using a coloring material-containing ink accommodated in a first accommodating portion and processing liquid contained in a second accommodating portion to make insoluble or coagulate the coloring material in the ink. This recording apparatus includes a means to hold a first ink jet head to eject the ink and a second ink jet head to eject the processing liquid in line and in an opposing relationship with the recording surface of the recording medium, and a control means to control the ejecting of the processing liquid from the second ink jet head in connection with the ejecting of the ink from the first ink jet head.

32 Claims, 19 Drawing Sheets

INK JET RECORDING APPARATUS

BACKGROUND OF THE INVENTION

1. Field of the Invention

The present invention relates to an ink jet recording apparatus, an ink cartridge and an ink jet head unit, and more particularly to an ink jet recording apparatus, an ink cartridge and an ink jet head unit, which are capable of high quality color recording with good water resistance and no spreading of ink.

The term "recording" includes application of ink to (or printing of) all kinds of ink supporting body such as cloth, threads, paper and sheet materials. This invention can be applied to any kind of equipment that use such recording materials as paper, cloth, nonwoven cloth and OHP sheets for over-head projector. Among equipment to which the invention is applicable are office equipment such as printers, copying machines and facsimiles, and also mass production equipment.

2. Description of the Prior Art/Related Art

The ink jet recording method involves ejecting small droplets of recording liquid and landing them on a recording material such as paper (hereinafter referred to as a recording medium) to record information.

This recording method, because of its advantages such as low noise, low running cost, small size of apparatus and ease with which color printing is implemented, has found wide use in printers and copying machines.

This kind of ink jet recording generally employs ink whose major component is water that contains water-soluble, high boiling point solvent, such as glycol, for the purpose of preventing drying and clogging. Recording the ordinary paper using such ink, however, may result in poor fixing of ink on the paper or non uniform image presumably due to uneven distribution of loading materials and sizes applied to the surface of the paper. When a color image is formed, in particular, ink droplets of two or more different colors are successively ejected overlapping the previous ones before the droplets that have landed become fixed to the recording medium, so that colors may get blurred at boundary portions in the image between different colors or mixed unevenly causing feathering. As a result, a satisfactory printed image may not be obtained.

To solve the above-mentioned problem, a method has been proposed which involves purchasing a particular recording medium applied over its entire surface to a specified thickness with a substance that fixes a dye in the recording liquid and ejecting the recording liquid against the recording medium.

With such a method, however, satisfactory recording cannot be realized unless the above-mentioned special recording mediums are purchased.

Another method is known which sprays a colorless treatment liquid, that renders the dye in the recording liquid insoluble, over a wide area on one surface of the recording medium irrespective of the positions where the recording liquid droplets are landed.

Because the treatment liquid is also applied to portions not related to ink ejection, the amount of the treatment liquid is far greater than the amount of ink used, increasing the running cost and the size of the apparatus.

SUMMARY OF THE INVENTION

A first object of this invention is to provide an ink jet recording apparatus as well as an ink cartridge and an ink jet head unit mountable on the apparatus, which can solve the above-mentioned conventional problems, can perform water-resistant, anti-bleed processing on a recorded image swiftly and accurately with a minimum amount of processing liquid, and can perform this processing without requiring a recording head of special construction for ejecting the processing liquid.

A second object of this invention is to provide an ink jet recording apparatus as well as an ink cartridge and an ink jet head unit mountable on the apparatus, which can realize, without degrading operability, high-quality, high-reliability image recording that exhibits improved water resistance for ordinary paper and produces no feathering or color bleed at the boundaries between different colors in color recording.

In order to achieve these objects, in a first aspect of the present invention, a recording apparatus, which performs recording on a recording medium by using a coloring material-containing ink accommodated in a first accommodating portion and processing liquid accommodated in a second accommodating portion to make insoluble or coagulate the coloring material in the ink, comprises:

- a means to hold a first ink jet head for ejecting the ink and a second ink jet head for ejecting the processing liquid in line with each other and opposite the recording surface of the recording medium; and
- a control means to control the ejecting of the processing liquid from the second ink jet head in connection with the ejecting of the ink from the first ink jet head.

Here, the first ink jet head and the second ink jet head may be arranged in the order of the second ink jet head and the first ink jet head in the direction in which these two heads perform at least the image recording so that the processing liquid can be ejected from the second ink jet head prior to the ejecting of the ink from the first ink jet head.

The first ink jet head and the second ink jet head may be combined together to form an ink jet head unit.

The ink jet head unit may be removably mounted on a carriage that reciprocally moves in a direction in which the unit moves when performing the image recording.

The ink jet head unit mounted on the carriage may be removably provided with the first accommodating portion that accommodates the ink containing the coloring material and with the second accommodating portion that accommodates the processing liquid to make insoluble or coagulate the coloring material in the ink.

It may further comprise a processing liquid supply means to supply the processing liquid to the second accommodating portion.

The processing liquid supply means may be removably fixed on a guide along which the carriage reciprocally moves and, only when the carriage moves to a predetermined position, is connected to the second accommodating portion to supply the processing liquid thereto.

The processing liquid supply means may further include a pressurizing pump that uses a driving force of the carriage to supply the processing liquid to the second accommodating portion.

The pressurizing pump may include bellows that pressurizes the interior of the processing liquid supply means when the second accommodating portion is connected to the processing liquid supply means.

The processing liquid supply means may include a soaking body that retains waste liquid of the processing liquid or the ink.

The first ink jet head may have an electro-thermal conversion body as an element that generates thermal energy for ejecting the ink.

In order to achieve these objects, in a second aspect of this invention, an ink jet head unit, comprises:

a first ink jet head to eject a coloring material-containing ink; and a second ink jet head to eject processing liquid to make insoluble or coagulate the coloring material in the ink;

wherein the first ink jet head and the second ink jet head are integrally combined.

Here, the second ink jet head and the first ink jet head may be arranged in this order in a direction in which the both heads move when performing at least image recording.

In order to achieve these objects, in a third aspect of this invention, an ink cartridge, comprises:

a first accommodating portion that is removably fixed to a first ink jet head which ejects a coloring material-containing ink, the first accommodating portion accommodating the ink to be supplied to the first ink jet head.

Here, the first accommodating portion may be divided into a first portion containing a absorbing body that absorbs and retains the ink and a second portion that accommodates the ink and communicates with the first portion through small holes.

The first accommodating portion may be divided according to the kind of the coloring material in the ink.

The first accommodating portion may be divided as claimed in the density of the ink.

In order to achieve these objects, in a fourth aspect of this invention, an ink cartridge, comprises:

a second accommodating portion that is removably fixed to a second ink jet head which ejects processing liquid to make insoluble or coagulate a coloring material contained in ink, the second accommodating portion accommodating the processing liquid to be supplied to the second ink jet head.

Here, a surface tension of the processing liquid may be smaller than the surface tension of the ink.

In order to achieve these objects, in a fifth aspect of this invention, an ink cartridge, comprises:

a first accommodating portion that accommodates ink to be supplied to a first ink jet head which ejects a coloring material-containing ink; and a second accommodating portion that accommodates processing liquid to be supplied to a second ink jet head which ejects the processing liquid to make insoluble or coagulate the coloring material in the ink;

wherein the first accommodating portion and the second accommodating portion are integrally combined.

The ink may contain anionic dye.

The ink may contain at least anionic compound and pigment.

The processing liquid may contain a cation substance including a low-molecular component and a high-molecular component.

With this invention, because the recording head is so arranged as to allow the processing liquid to be sprayed prior to the ejecting of ink onto the recording medium, it is possible to apply a sufficient amount of processing liquid for recording to the recording medium. According to the recording data, the processing liquid is sprayed over only the locations on the recording medium where the ink is to be ejected, so that the ink lands on the applied processing liquid. This makes it possible to form a desired stable image by using only the minimum required amount of processing liquid, thereby optimizing the amount of processing liquid applied prior to the ink ejecting and lowering the running cost and the manufacture cost of the apparatus.

Further, because the recording heads of the same construction and configuration are employed, there is no need to change the design of the recording head according to whether the droplets to eject are the processing liquid or the ink, thus improving the development efficiency and productivity.

Moreover, the recording head for ejecting the ink containing a coloring material and the recording head for ejecting the processing liquid for coagulating the coloring material in the ink may be integrally held by a frame, or the nozzle for the ink containing the coloring material and the nozzle for the processing liquid that coagulates the coloring material in the ink may be provided in the same recording head. This construction makes it possible to eject the processing liquid and the ink immediately following it in each line during each scan of the recording heads. This in turn allows the original purpose of the processing liquid to be accomplished even when the image data transfer from the host computer is halted.

Furthermore, the recording heads for ejecting the processing liquid may be arranged on both sides of the recording head for ejecting the ink. This construction makes it possible to apply the processing liquid to the recording medium even during the bi-directional scan of the carriage, which in turn allows the output time to be reduced by the bi-directional recording and the recording speed to be improved.

In the ink jet recording apparatus of this invention, the colorless or light-colored transparent liquid (referred to as a processing liquid) containing a compound to render dye in the ink insoluble is sprayed onto the recording medium according to the image information, followed by ink of one color or two or more colors being ejected against the recording medium according to the image information. The apparatus has a dedicated tank for the processing liquid whose capacity is equal to or greater than that of the colored ink tank and which is installed in the apparatus body. The apparatus is so constructed as to make easily recognizable to an operator the necessity for replacing the tank of the processing liquid. High reliability of the recording apparatus is thus realized.

These and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of this invention will be described in detail by referring to the accompanying drawings.

Figure 1:
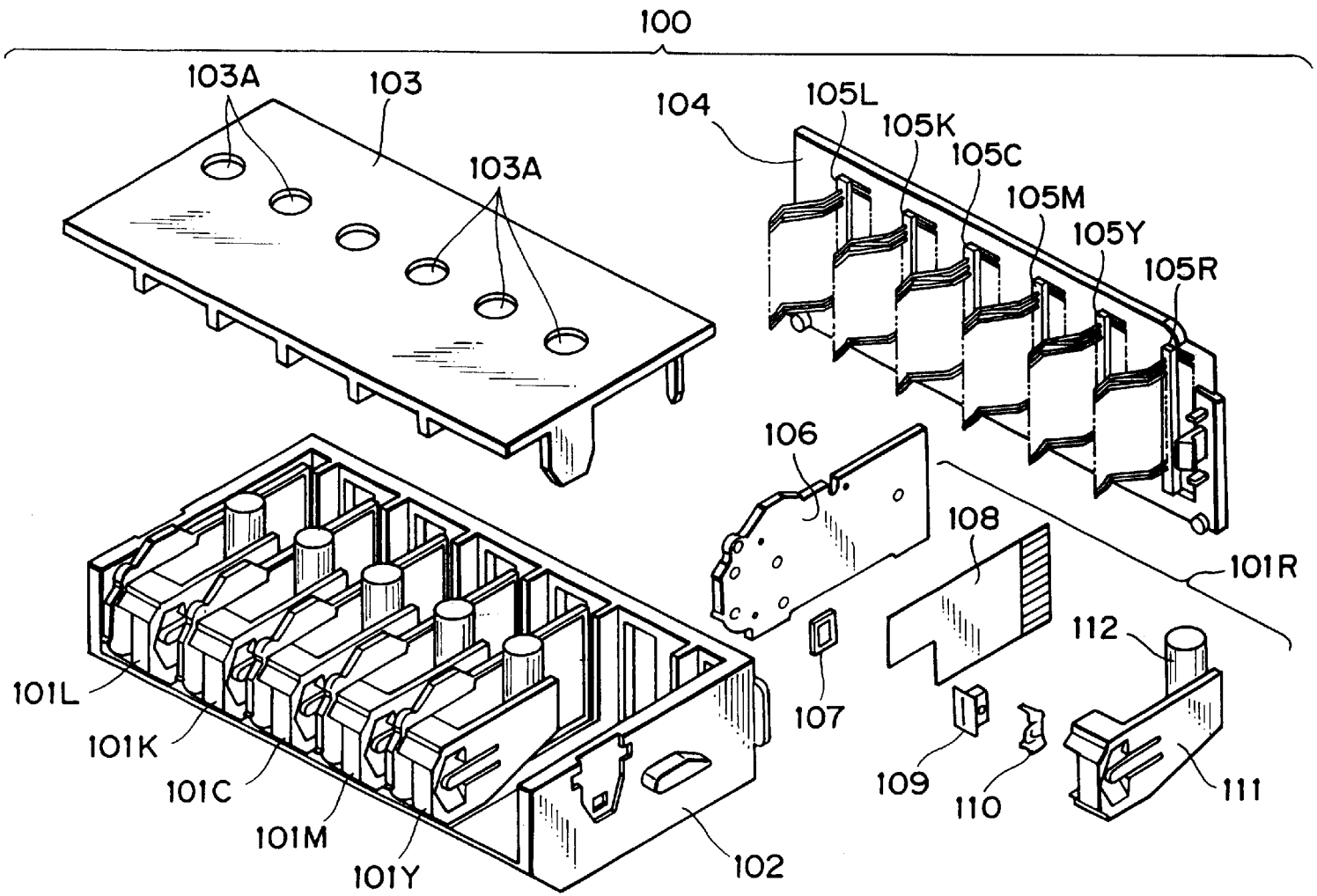
FIG. 1 is an exploded perspective view of one example of an ink jet head unit of this invention.
Figure 2:
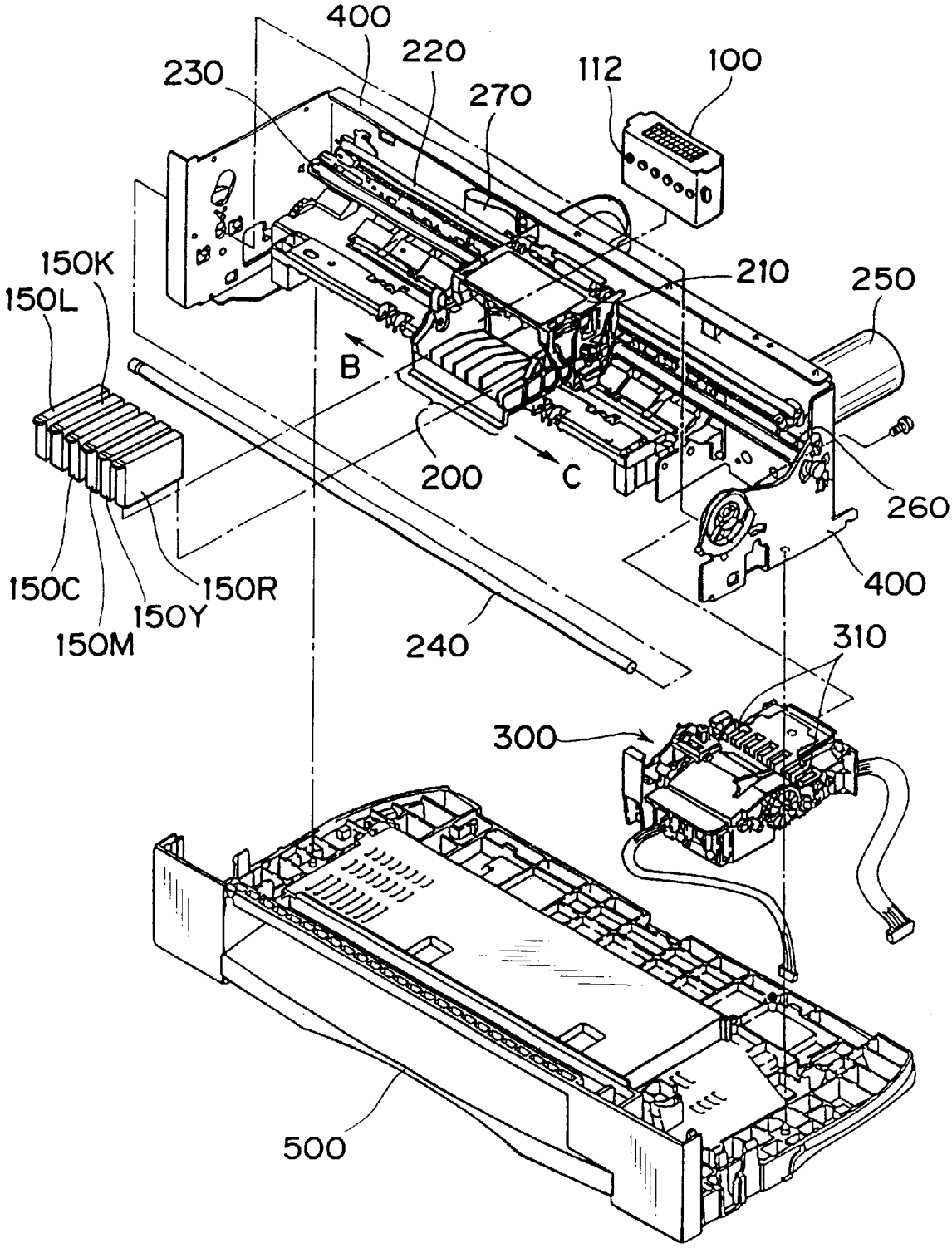
FIG. 2 is an exploded perspective view of one example of a recording apparatus of this invention in which the ink jet head unit of FIG. 1 can be mounted.
Figure 3:
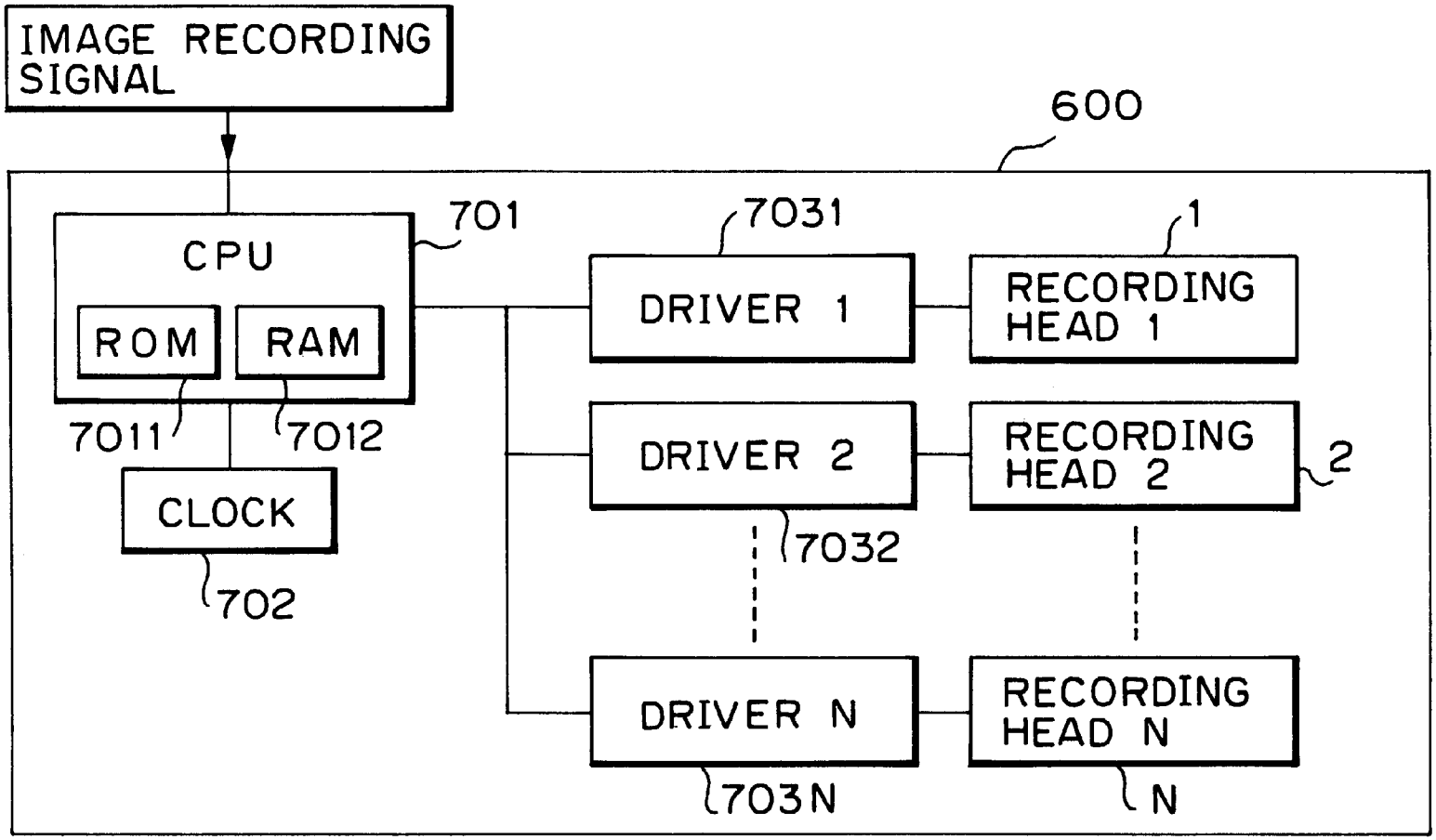
FIG. 3 is a block diagram showing the control circuit configuration.

FIGS. 1 to 3 represent a first embodiment of this invention, FIG. 1 showing the construction of the ink jet head unit of the first embodiment, FIG. 2 showing the construction of the ink jet recording apparatus mounting the ink jet head unit, and FIG. 3 showing the configuration of the control circuit.

FIG. 1 is an exploded perspective view of the ink jet head unit 100. Reference numeral 101L and 101R represent an ink jet head (also referred to as a recording head) for ejecting processing liquid. Designated 101K, 101C, 101M and 101Y are color recording heads that eject ink of black (K), cyan (C), magenta (M) and yellow (Y). A frame body 102 holds these recording heads 101L–101R at specified intervals. Denoted 103 is a cover member engaged with the frame body 102. A side plate 104 is engaged with the frame body 102 and the cover member 103. The side plate 104 has lead frames 105L–105R that hold a plurality of lead wires electrically connected to the individual recording heads 101L–101R. The cover member 103 is provided with holes 103A through which to pass supply tubes 112 for the recording heads 101L–101R that are connected to ink cartridges containing processing liquid or ink.

These recording heads 101L–101R are constructed functionally identical and are assembled into the frame body 102 according to the required recording superposition accuracy. One of the recording heads 101R is shown disassembled. The recording head includes a metal base plate 106 made of, for example, aluminum that functions as a frame of the recording head and as a heat dissipation plate, a chip like heater board 107 on one surface of which are formed a row of electro-thermal conversion elements, an electric wiring board 108 having wires electrically connected to the heater board 107, a top plate member 109 formed with an ink ejecting nozzle, a liquid path and a common liquid chamber (not shown), a retainer spring 110, and a connection and supply member 111 for supplying processing liquid or ink to the common liquid chamber formed in the top plate member 109 through the supply tube 112.

Next, the construction of the ink jet recording apparatus that mounts the ink jet head unit 100 along with the processing liquid or ink cartridge on the carriage will be described by referring to FIG. 2.

In this embodiment the ink jet head unit 100 has the processing liquid ejecting heads 101L, 101R arranged on both sides of the color recording heads 101K–101Y to allow recording during the two-way reciprocal scan by the carriage. In a construction where the recording is done only during one-way scan, however, the processing liquid ejecting head may be provided only on the side of that scan direction.

In FIG. 2, processing liquid cartridges 150L, 150R that contain processing liquid are connected to the processing liquid ejecting heads 101L, 101R through the supply tubes 112 to supply the processing liquid to these heads. Ink cartridges 150K, 150C, 150M and 150Y are connected to the color recording heads 101K, 101C, 101M and 101Y, respectively, through the supply tubes 112. That is, the ink jet head unit 100 integrally holding the recording heads 101L–101R is mounted on a carriage 200, on which the recording heads 101L–101R are connected with the corresponding cartridges 150L–150R with a head cover 210 put on the ink jet head unit 100.

Denoted 220 is a timing belt that is connected to the carriage 200 to move it along a guide shaft 230 and a support shaft 240 at a predetermined timing (main scan). Designated 250 is a belt drive motor. A linear scale 260 is provided in the scan direction and its position is read by a reading device not shown which is fixed on the carriage 200. Flexible cables 270 are connected through the lead frames 105L–105R of FIG. 1 to the individual recording heads 101L–101R to supply ejecting signals to the heads according to predetermined timing. A recovery device 300 is mounted outside the recording region of the recording heads 101L–101R. In this example, when the carriage 200 is moved in the direction of arrow C to the standby position outside the recording region, cap members 310 of the recovery device 300 are brought into contact with the nozzle surfaces of the recording heads 101L–101R to suck and remove viscous liquid adhering to the nozzles and thereby eliminate clogging of the nozzles. The recovery device 300 is provided with a pump (not shown) for this purpose. These members are secured to a chassis 400 or to a bottom case 500 that supports the chassis 400. The bottom case 500 is mounted with exterior components not shown.

In the ink jet recording apparatus 600 of such a construction, as the carriage 200 performs a two-way reciprocal scan in the directions of arrow B and C, the recording heads 101K, 101C, 101M, 101Y eject ink of respective colors according to specified timings to record a color image. In this case, the position of the carriage 200 and the ejecting timing of processing liquid or color ink from the recording heads 101L–101R are completely synchronized. In this embodiment, during the scan in the direction of arrow B, the processing liquid is ejected from the recording head 101L, after which color ink from the color recording heads 101K–101Y is selectively ejected at the same positions where the processing liquid droplets have landed. Likewise, during the scan operation of the carriage 200 in the direction of arrow C, the recording head 101R first delivers the processing liquid, followed by the color ink being ejected at the same positions where the processing liquid has landed. In this way, during the two-way reciprocal scan, the processing liquid droplets are applied first and then the color ink droplets are ejected, thus realizing the color recording during the bi-directional scan.

Here, the method of preparing the processing liquid and ink used in this invention as well as their components are described.

The colorless liquid as the processing liquid that renders the ink dye insoluble may, for example, be prepared in the following manner.

That is, first of all, the following ingredients are mixed. The mixture is then filtrated through a membrane filter of 0.22 mm in pore size (tradename: Floropore filter, Sumitomo Denko Co., LTD.). A filtrate solution is adjusted to pH 4.8 by adding NaOH to obtain the liquid A1.

Composition of A1

| | |
|---|---|
| a low molecular ingredient of a cationic compound stearyl trimethyl ammonium chloride (tradename: Electro-stopper QE, manufactured by Kao Co., Ltd.) | 2.0 parts by weight |
| a high molecular ingredient of a cationic compound polyamine sulfone (average molecular weight: 5,000) (tradename: PAS-92, manufactured by Nitto Boseki, Co., LTD.) | 3.0 parts by weight |
| thiodiglycol | 10 parts by weight |
| water | remains |

Also, the ink to being insoluble by mixing with the above liquid is preferably prepared by the following steps and contains the following ingredients. That is, yellow ink Y1, magenta ink M1, cyan ink C1, and black ink K1 are obtained, respectively, by the process comprising the steps of:

mixing the following ingredients; and filtrating the mixture through a membrane filter (tradename: Chrolopore filter, Sumitomo Denko, Co., LTD) of 0.22 mm in pore size under pressure.

Y1

| | |
|---|---|
| C.I Direct yellow 142 | 2 parts by weight |
| Thiodiglycol | 10 parts by weight |
| Acetylenol EH (Kawaken Fine-Chemical, Co., LTD.) | 0.05 parts by weight |
| Water | remains |

M1

M1 is prepared from the same ingredients except that 2.5 parts of acid red 289 is used as a dyestuff instead of C.I Direct yellow 142.

C1 is prepared from the same ingredients except that 2.5 parts of acid blue 9 is used as the dyestuff instead of C.I Direct yellow 142.

K1 is prepared from the same ingredients except that 3 parts of hood black 2 is used as the dyestuff instead of C.I Direct yellow 142.

The liquid and the ink, both having one of the above compositions (aqueous compositions), are mixed with each other at a certain inner or surface position of the recording medium as a result of their permeation therethrough. In the mixture, as a first stage of the reaction, the low molecular ingredient or the cationic oligomer of the cationic substance is associated with the anionic compound used in a pigment ink or with a water-soluble dye having an anionic group used in an ink. The moment they are associated, a phase separation occurs and results in an aggregation of the pigments or dyestuff by means of a dispersion-breakdown caused in the ink or the pigment ink. It should be noted that a surface tension of the processing liquid is preferably smaller than a surface tension of the ink.

As a second stage of the reaction, an aggregate of the dyestuff or the pigments generated as a result of the above association becomes larger by adsorbing the aggregate on the surface of the high molecular ingredient being included in the liquid. Consequently, it becomes difficult to introduce the aggregate into the space formed among fibers of the printing medium, while an aqueous part of the mixture without a solid part is able to permeate through the printing medium. Accordingly, the high printing quality and the stable fixation can be consistent with each other.

Furthermore, the above aggregate becomes highly viscous, so that the aggregate cannot pass through the printing medium in company with the aqueous medium. Regardless of arranging the different color-ink dots so as to being adjacent to each other, as in the case of a multiple-color image formation, there is no mixing and bleeding between these different ink dots. In this case, furthermore, a light-fastness of the image can be also improved by forming the image with a screening effect of the polymer.

By the way, the term "insoluble" or "aggregation" means the observable events in only the above first step or in both the first and second steps.

For carrying out the present invention, furthermore, there is no need to use a high-molecular cationic substance and a polyvalent metal salt. Alternatively, the amount of using these substances can be kept at the minimum when there is need to use them. Because they are only used as secondary substances for further improving an effects of the present invention. As a result, we are able to give another effect of the present invention in that the present invention enables to prevent a lowering of coloring properties of the dyestuff. The lower coloring properties of the dyestuff is a problem to be caused by using the high-molecular cationic substance and the polyvalent metal salt for obtaining an effect of water-resistant in the conventional method.

The printing medium to be used for carrying out the present invention is not limited to a specific medium. It can be preferably selected from any kinds of normal paper, such as copy paper, bond paper, and so on, which have been used in the conventional printing process. It is noted that coated paper prepared especially for the ink-jet printing and transparent paper for a overhead projector can be also applied as the printing medium of the present invention. Furthermore, general wood-free paper and glossy paper are preferably used in the present invention.

For embodiments of the present invention, employed ink is not limited to especially the dyestuff ink but. also it is possible to use the ink comprising dispersed pigments. In the latter case, the liquid can be an agglutination of the pigment. The followings are examples of the pigment ink that causes an agglutination by mixing with the above-mentioned liquid A. That is, as will be described, each color ink of yellow Y2, magenta M2, cyan C2, and black K2 is prepared in the form of comprising a pigment and an anionic compound.

Black ink K2

An anionic high-molecule P-1 (stylene-methacrylic acid-ethylacrylate, an acidic value 400, an average molecular weight 6,000, an aqueous solution containing 20% solid material, and a potassium hydroxide as a liquid neutralizing agent) is used as a dispersion agent. The following materials are filled in a vertical batch-type sand mill (manufactured by Imex Co., LTD) and then glass beads of 1 mm in diameter are provided as media to fill the hole tightly. After that, the mixture is subjected to a water-cooled dispersion treatment for three hours, resulting that a fluid dispersion having the viscosity of 9 cps and the pH of 10.0. The obtained fluid dispersion is centrifuged by a centrifuge to separate contained materials of different specific gravities to remove coarse particles. Consequently, a dispersion body of carbon-black with an average particle diameter of 100 nm.

Composition of the Carbon-black Dispersion Body

| | |
|---|---|
| P-1 aqueous solution (including 20% of solidified portion) | 40 parts by weight |
| Carbon black Mogul L (Cablack made) | 24 parts by weight |
| Glycerin | 15 parts by weight |
| Ethylene glycol monobutylether | 0.5 parts by weight |
| Isopropyl alcohol | 3 parts by weight |
| Water | 135 parts by weight |

A black ink K2 for the ink-jet printing, comprising pigments as sufficiently-dispersed bodies obtained by the above procedure, is thus prepared. A solidified portion of the final preparation is about 10%.

Yellow ink Y2

An anionic high-molecular substance P-2 (stylene-acryl acid-methylmetacrylate, an aqueous solution having an acid value of 280, a molecular weight of 11,000, and a solid content of 20%, and neutralizer diethanolamine) is used as a dispersion agent. The dispersion is managed similarly to the process of preparing the black ink K2 by means of the following materials. Consequently, a yellow color dispersion body of 103 nm in average particle diameter is obtained.

Composition of the Yellow Dispersion Body

| | |
|---|---|
| P-2 aqueous solution (20% of solid content) | 35 parts by weight |
| C.I. Pigment yellow 180 (Tradename: Nova parm yellow - PH-G, manufactured by Hexist Co., LTD.) | 24 parts by weight |
| Triethylene glycol | 10 parts by weight |
| Diethylene glycol | 10 parts by weight |
| Ethyleneglycol monobutylether | 1.0 parts by weight |
| Isopropyl alcohol | 0.5 parts by weight |
| Water | 135 parts by weight |

A yellow ink Y2 for the ink-jet recording, comprising pigments as sufficiently-dispersed bodies obtained by the above procedure, is thus prepared. A solidified portion of the final preparation is about 10%.

Cyan ink C2

The anionic high-molecular substance P-1, which is used in the preparation of the black ink K2, is also used as a dispersion agent for preparing the cyan ink Y2. The dispersion treatment is managed similar to the process of preparing the carbon-black dispersion by means of the following materials. Consequently, a cyan color dispersion body of 120 nm in average particle diameter is obtained.

Composition of the Cyan Dispersion Body

| | |
|---|---|
| P-1 aqueous solution (20% of solid content) | 30 parts by weight |
| C.I. Pigment blue 15:3 (Tradename: Fastgenbul-FGF, manufactured by Dai Nippon Ink Chemicals, Co., LTD.) | 24 parts by weight |
| Triethylene glycol | 10 parts by weight |
| Glycerin | 15 parts by weight |
| Diethylene glycol monobutylether | 15 parts by weight |
| Isopropyl alcohol | 3 parts by weight |
| Water | 135 parts by weight |

A cyan ink C2 for the ink-jet recording, comprising pigments as sufficiently-dispersed bodies obtained by the above procedure, is thus prepared. A solidified portion of the final preparation is about 9.6%.

Magenta ink MC2

The anionic high-molecular substance P-1, which is used in the preparation of the black ink K2, is also used as a dispersion agent for preparing the magenta ink M2. The dispersion treatment is managed similar to the process of preparing the carbon-black dispersion by means of the following materials. Consequently, a magenta color dispersion body of 115 nm in average particle diameter is obtained.

A Composition of the Magenta Dispersion Body

| | |
|---|---|
| P-1 aqueous solution (20% of solid content) | 24 parts by weight |
| C.I. Pigment red 122 (manufactured by Dai Nippon Ink Chemicals, Co., LTD.) | 24 parts by weight |
| Glycerin | 15 parts by weight |
| Isopropyl alcohol | 3 parts by weight |
| Water | 135 parts by weight |

A magenta ink M2 for the ink-jet recording, comprising pigments as sufficiently-dispersed bodies obtained by the above procedure, is thus prepared. A solidified portion of the final preparation is about 9.2%.

Next, the circuit configuration to implement the recording according to this invention will be explained by referring to FIG. 3.

In FIG. 3, denoted 701 is a central processing unit (CPU) that performs overall control of the ink jet recording apparatus 600 and has a memory device ROM 7011 and a memory device RAM 7012. The memory device ROM 7011 stores control operations to be performed during the recording according to this invention and control procedures for various operations to be performed during the recording. The CPU 701 also has a memory device RAM 7012 that temporarily stores data. Denoted 702 is a clock that defines signals for recording; 7031, 7032, . . . , 703N drivers for driving the recording heads 1, 2, . . . , N. In the above embodiment, there are six recording heads and hence the recording heads 1, 2, . . . , N correspond to the recording heads 101R, 101Y, . . . , 101L. Here, explanation of the driving means and its driver associated with the main scan of the carriage 200 or with the feeding of the recording medium (sub-scan) is omitted.

Figure 4:
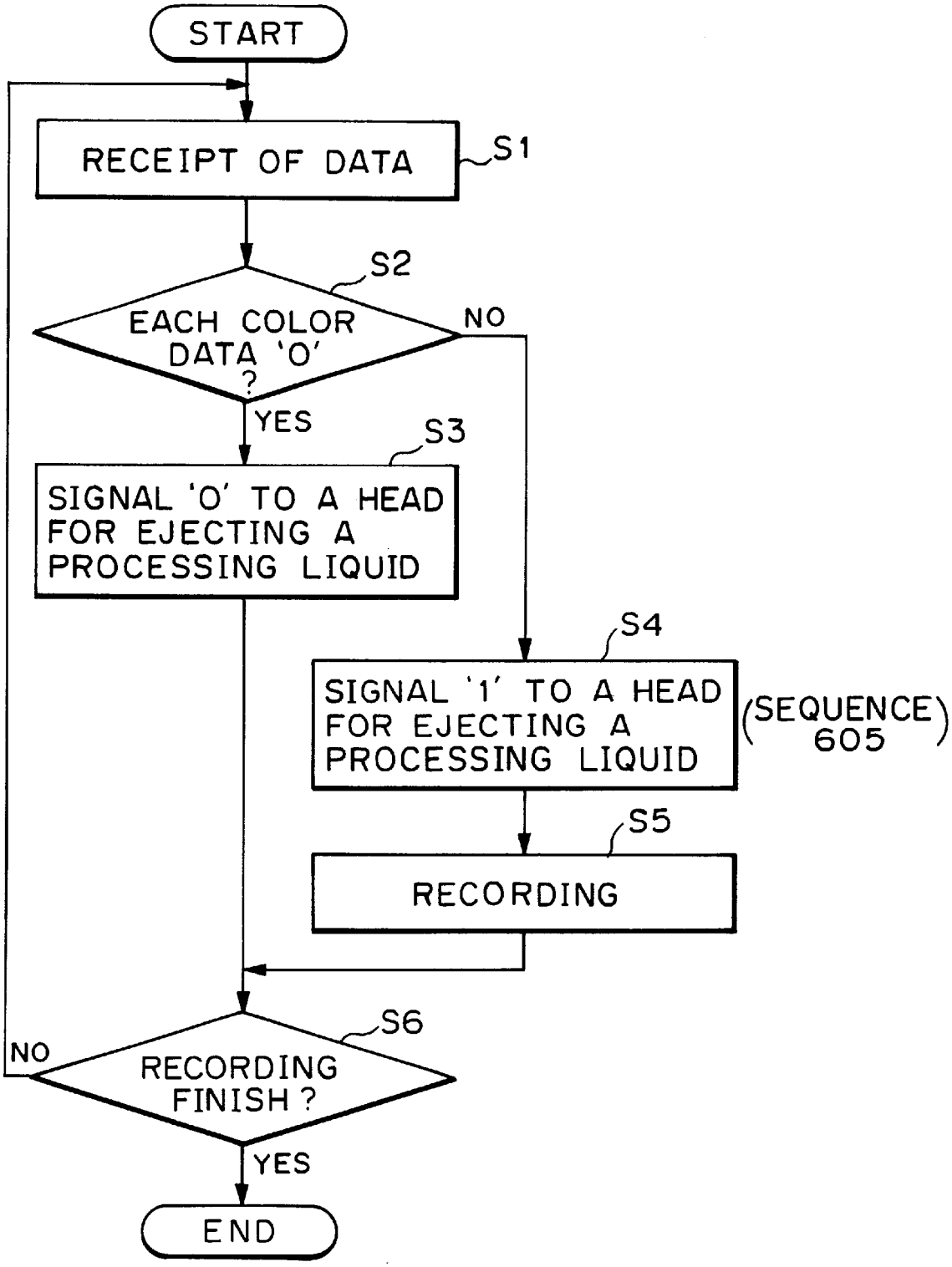
FIG. 4 is a flowchart showing the sequence of control operation according to this invention.

Next, the sequence of the control operation according to this invention will be explained by referring to FIG. 4.

In the case of color recording, when image recording signals for individual colors are received in step S1 from the host computer, a check is made for each color in step S2 to decide whether or not ink should be ejected. The CPU 701 is supplied a signal "0" if it is decided that ink ejection shall not be performed, or a signal "1" if ink ejection shall be performed. In step S2 if it is decided that ink ejection shall not be performed for any color, there is no need to deliver the processing liquid and the program proceeds to step S3 where it sends the non-ejection signal "0" to the recording heads 101L and 101R (see FIG. 1) that spray the processing liquid. If at step S2 it is decided that ink ejection is to be performed for some colors, the program proceeds to step S4 where it feeds the processing liquid ejection signal "1" to either the recording head 101L or 101R.

In this case, before the color recording heads 101K–101M eject color ink during the main scan, it is necessary to land the processing liquid at positions on the recording medium where the color ink is to be ejected. When the recording is made during the scan, for example, in the direction of arrow C in FIG. 2, the ejection signal "1" need only be supplied to the recording head 101R. When the recording is made during the scan in the direction of arrow B, only the recording head 101L is supplied the ejection signal "1." Then, the program goes to step S5 where it drives the color ink recording heads 101K–101Y at specified timings during the scan to perform recording. A step S6 checks if the recording is completed. If at step S6 the succeeding recording is requested, the recording medium is fed in the sub-scan direction and then the processing returns to step S1, from which the control sequence is repeated.

In this way, because the recording heads for the processing liquid are arranged in parallel with the color ink recording heads, it is possible to apply the required and sufficient amount of processing liquid droplets only when needed onto the recording medium prior to ejection of color ink onto the recording medium in the bi-directional recording.

The above embodiment concerns a case where the position scale signal is referenced for the ejection control of the recording head. When the position scale is not used and the carriage is driven by a pulse motor, it is apparent that the ink ejection control can also be performed by using the number of pulses of the pulse motor instead of the position scale signal.

When the bi-directional recording is not performed, the similar effect can be obtained by landing the processing liquid droplets prior to the ink ejection at the same positions where the ink is to be landed.

Figure 5:
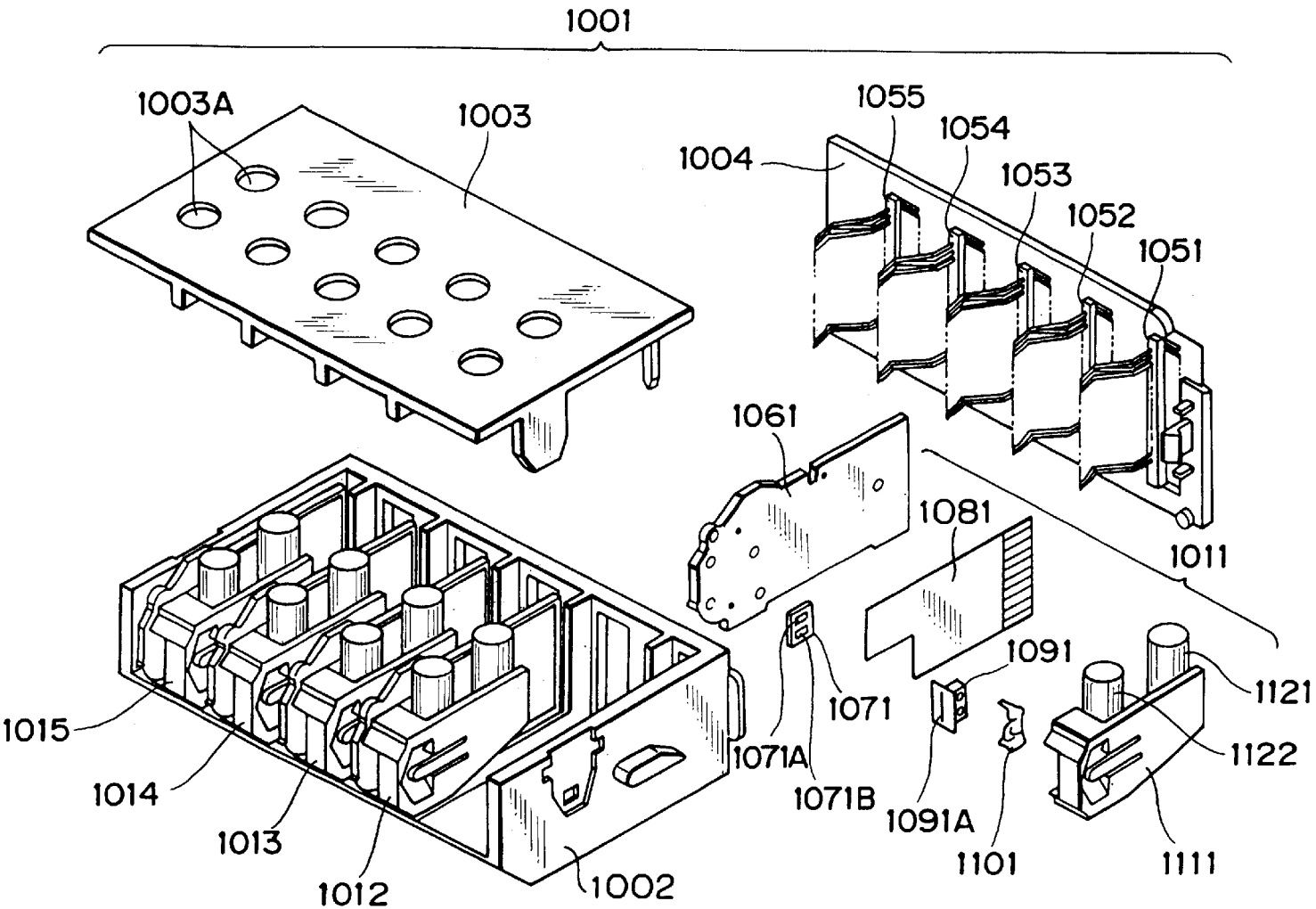
FIG. 5 is an exploded perspective view of another example of an ink jet head unit of this invention.
Figure 6:
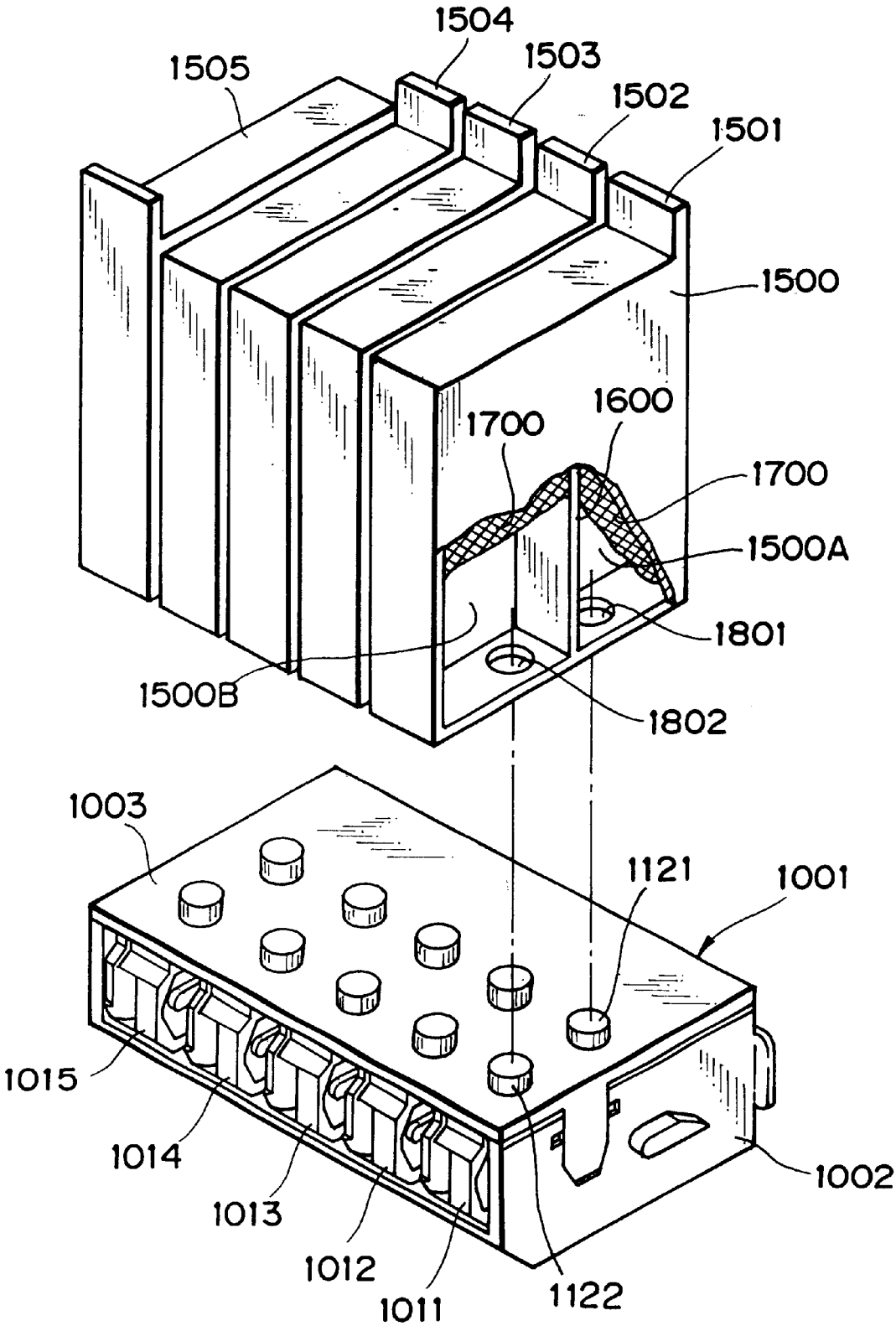
FIG. 6 is a perspective view schematically showing the combination of the ink jet head unit of FIG. 5 and an ink cartridge.

FIGS. 5 and 6 show the second embodiment of this invention. FIG. 5 shows the construction of the ink jet head unit 1001 of the second embodiment. The ink jet head unit 1001 incorporates a total of five sets of recording heads, of which two sets are black ink recording heads and three sets are color ink recording heads. These recording heads are each divided into two systems, each of which can eject the processing liquid or color ink.

In the attitude of the recording heads 1011–1015 as shown in FIG. 5, the ejection mechanism for the first system is arranged on the upper half of each head and the ejection mechanism for the second system on the lower half. As to the metal base plate 1061, the electric wiring board 1081 and the retainer spring 1101 in the overhauled state of the recording head 1011, they are similar to those shown in FIG. 1. The heater board 1071, however, has a row of electrothermal conversion devices which are arranged on its surface divided into a first system row 1071A on the upper half and a second system row 1071B on the lower half. The liquid path and the common liquid chamber (both not shown) provided in the top plate member 1091 are also divided and separated into two systems. Though not shown, the ink nozzle 1091A formed in the ink nozzle surface is also divided. Further, the connection and supply member 1111 is also provided with separate supply tubes 1121, 1122 for two systems.

The recording heads 1011–1015 are constructed similar to the recording head 1011. The recording head 1011 has its first system supplied with the processing liquid through the supply tube 1121 and the second system supplied with the black (K) ink through the supply tube 1122. The recording heads 1012, 1013, 1014 have both the first and second systems supplied with ink of yellow (Y), magenta (M) and cyan (C), and the recording head 1015 has its first system supplied with black (K) ink and its second system with the processing liquid. The basic construction of the frame body 1002, the cover member 1003 and the side plate 1004 are similar to that of the frame body 102, the cover member 103 and the side plate 104. Designated 1003A are holes cut in the cover member 1003. Lead frames 1051, 1052, 1053, 1054, 1055 provided in the side plate 1004 support the flexible cables electrically connected to the recording heads 1011, 1012, 1013, 1014, 1015.

Next, the construction of the cartridge tanks 1501–1505 and their connections to the ink jet head unit 1001 are explained by referring to FIG. 6.

The ink cartridges 1501–1505 are made in identical structures. Of these, the ink cartridges 1501 and 1505 have simply changed their longitudinal positions for accommodating the black (K) ink and the processing liquid. For the sake of simplicity, only the ink cartridge 1505 is shown directed in the opposite direction with respect to the ink cartridge 1501 in this embodiment. These ink cartridges are each divided by the partition wall 1600. Preferably, as shown in the Fig., the case 1500 is divided by the partition wall 1600, with the divided tank space 1500A (first system tank) and 1500B (second system tank) filled with a negative pressure generation member 1700 that retains ink or processing liquid. The divided tank spaces 1500A and 1500B are provided with liquid supply ports 1801, 1802, which are connected water-tight to the corresponding supply tubes 1121, 1122 when the ink cartridges are mounted.

With the recording heads 1011–1015 of the ink jet head unit 1001 and the ink cartridges 1501–1505 connected in this way, the recording heads 1011–1015 of the first system are supplied with the processing liquid, yellow ink, magenta ink, cyan ink and black ink, respectively, from the divided tank spaces 1500A located on the rear side of the ink cartridges 1501–1505, and the recording heads of the second system are supplied with black ink, yellow ink, magenta ink, cyan ink, and processing liquid, respectively, from the divided tank spaces 1500B located on the front side of the ink cartridges 1501–1505. To form the ink cartridges 1501–1505 in the same construction, this embodiment provides all the cases 1500 with the partition walls 1600. Because the ink cartridges 1502–1504 of 1501–1505 accommodate the same kind of ink in two divided tank spaces, these ink cartridges 1502–1504 need not be provided with the partition walls 1600.

In this combination of the ink jet head unit and ink cartridges constructed as described above, the same recording head is used either as the first system or the second system depending on the direction of the main scan to eject color ink immediately after the processing liquid has been ejected, thereby realizing the bi-directional recording.

Figure 7:
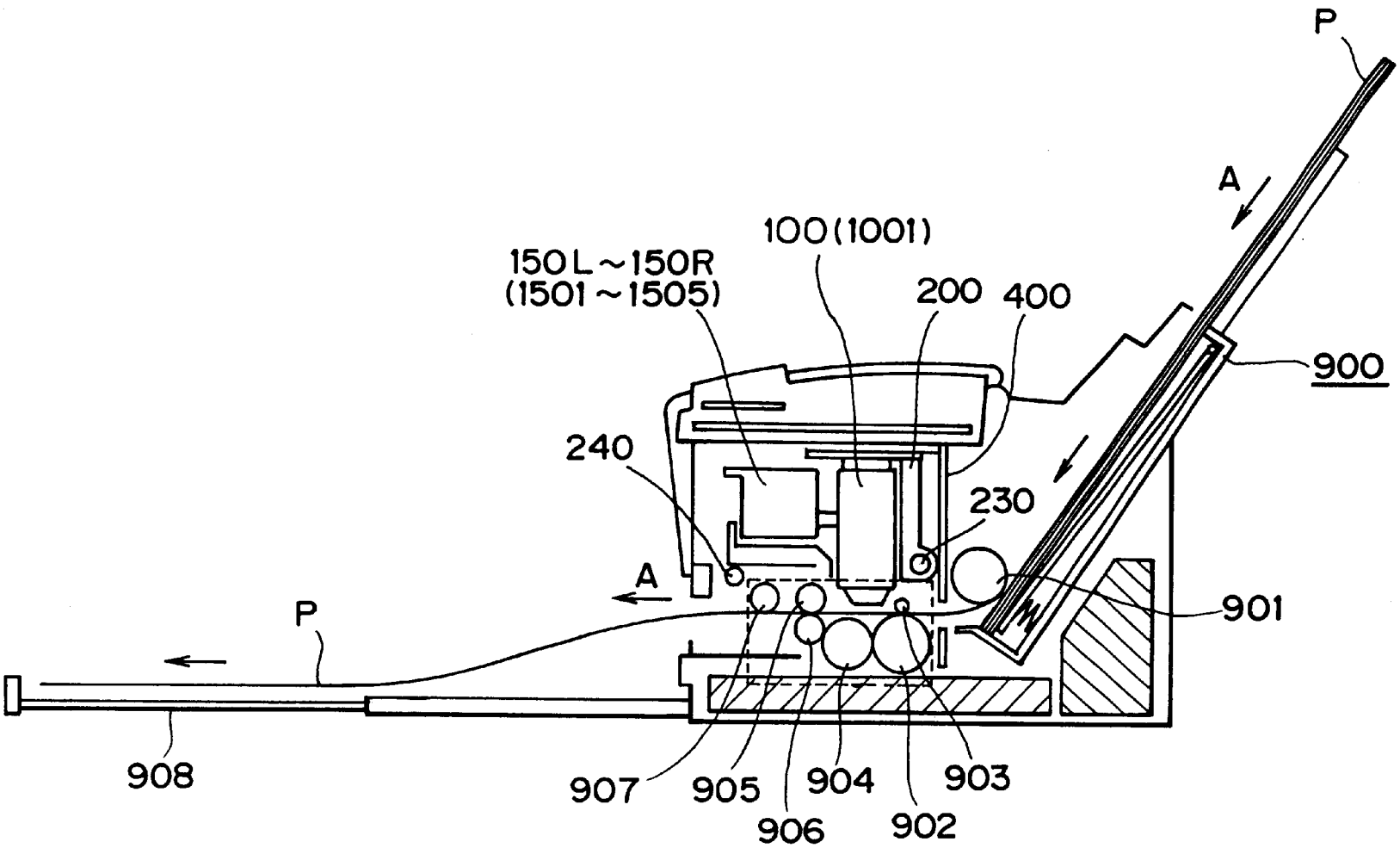
FIG. 7 is a cross sectional view showing an example construction of a printer as the recording apparatus of this invention.

FIG. 7 shows the construction of a printer to which the ink jet recording apparatus of this invention can be applied. A sheet feeding means 900 which accommodates a stack of recording mediums P as the recording mediums feeds the topmost sheet P in the direction of arrow A one by one by a feed roller 901. Denoted 902 and 903 are a transfer roller pair. A drive transmission roller 904 conveys the driving force of the transfer roller pair to a discharge roller pair 905, 906. A guide roller 907 guides the recorded sheet P discharged from the discharge roller pair 905, 906 onto a discharge tray 908. The recording operation of such a printer is known and hence its explanation is omitted here.

As described above, the first aspect of this invention offers the following advantages. In the ink jet recording apparatus that uses a tank portion which accommodates separately the ink containing a coloring material and the processing liquid for coagulating the coloring material in the ink and a plurality of recording heads that can eject the ink and the processing liquid separately, because the plurality of recording heads are arranged so as to allow the ejection of the processing liquid prior to the ejection of the ink onto the recording medium, it is possible to land the required and sufficient amount of processing liquid droplets at the dot recording positions on the recording medium. That is, according to the recording data, the processing liquid is applied only to the positions on the recording medium where the ink is to be ejected, and then the ink is ejected and landed on the applied processing liquid, making the coloring material in the ink insoluble. This allows a desired image to be formed stably only with the minimum required amount of processing liquid. This in turn optimally minimizes the required amount of processing liquid, reducing the running cost and the manufacture cost of the apparatus body. Because the same recording heads are arranged in a row, there is no need to differentiate the design of the individual recording heads according to the kinds of processing liquid and ink, thus improving the development efficiency and productivity. Furthermore, because both the processing liquid and the ink are ejected in each line during each scan of the recording heads, the original purpose of the processing liquid can be accomplished even when the image data transfer is halted. In addition, because the processing liquid is landed on the recording medium prior to ink ejection during the bi-directional scan motion of the carriage, it is possible to reduce the output time by performing the bi-directional recording and thereby to improve the speed of the recording.

In this way, it is possible to provide a recording apparatus which has high recording speed and low running cost and which can produce high quality images with high water resistance and no blurring at the boundaries between different colors.

According to the second aspect of this invention, the recording apparatus includes a container section that accommodates for each system the ink containing a coloring material and the processing liquid that coagulates the coloring material in the ink; a composite recording head which has ejecting nozzles for ejecting the ink and the processing liquid according to the drive signals for each system; and recording heads dedicated for ejecting ink which have ejecting nozzles for ejecting only the ink according to the drive signals for each system. The composite recording head and the ink-dedicated recording heads are arranged so that the processing liquid can be ejected prior to the ejecting of the ink when each system is operated. This arrangement makes it possible to eject the processing liquid first and then perform the recording as the recording heads of the first or second system are driven in each reciprocal scan by the carriage without feeding the sheet, thus producing the above-mentioned effects.

Although this embodiment has the ink jet head unit and the ink cartridges separated from each other, it is apparent that the desired effects can also be produced if these are formed integral.

Figure 8:
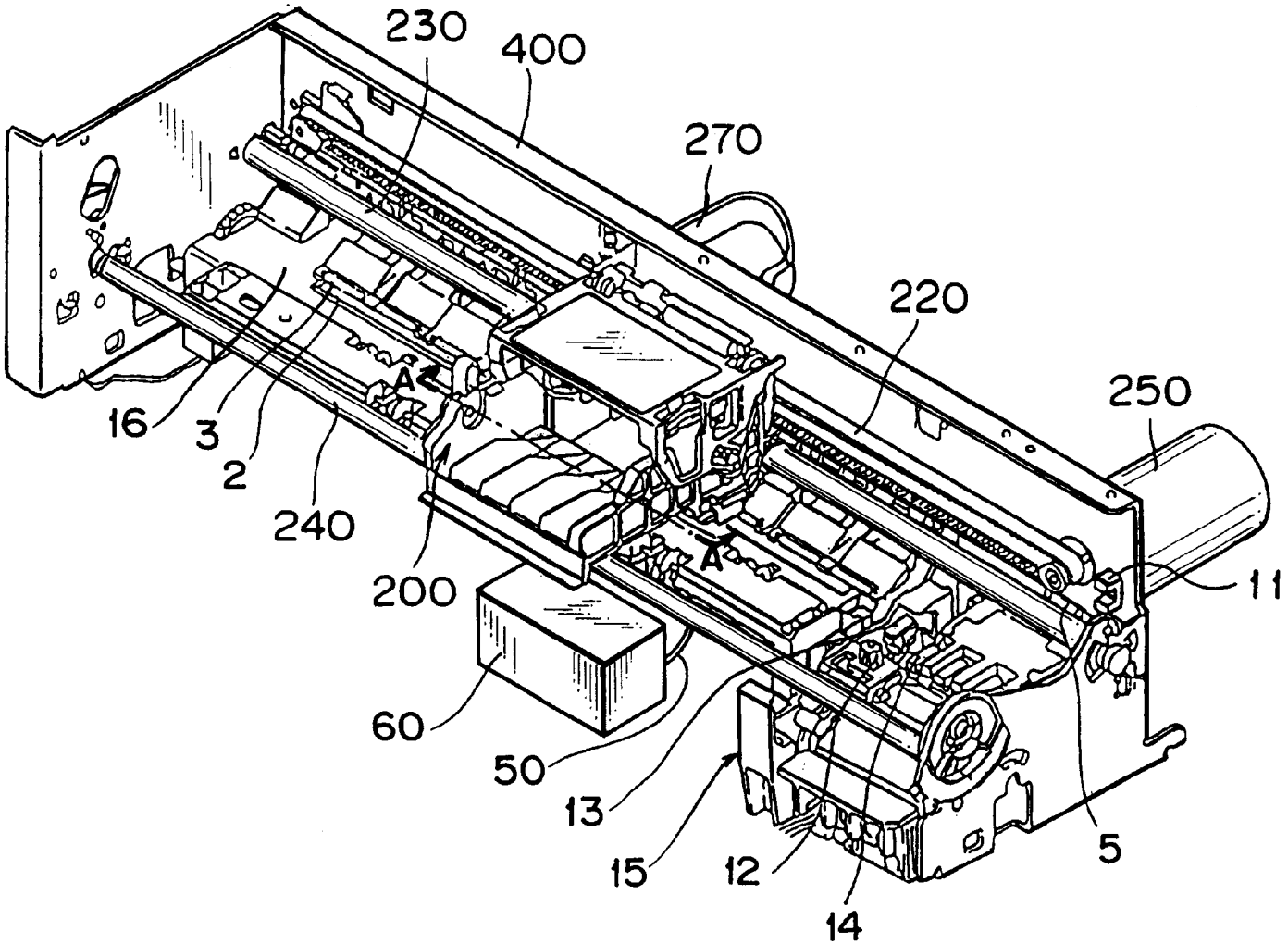
FIG. 8 is an outline perspective view showing still another example of the recording apparatus of this invention having a processing liquid tank.
Figure 9:
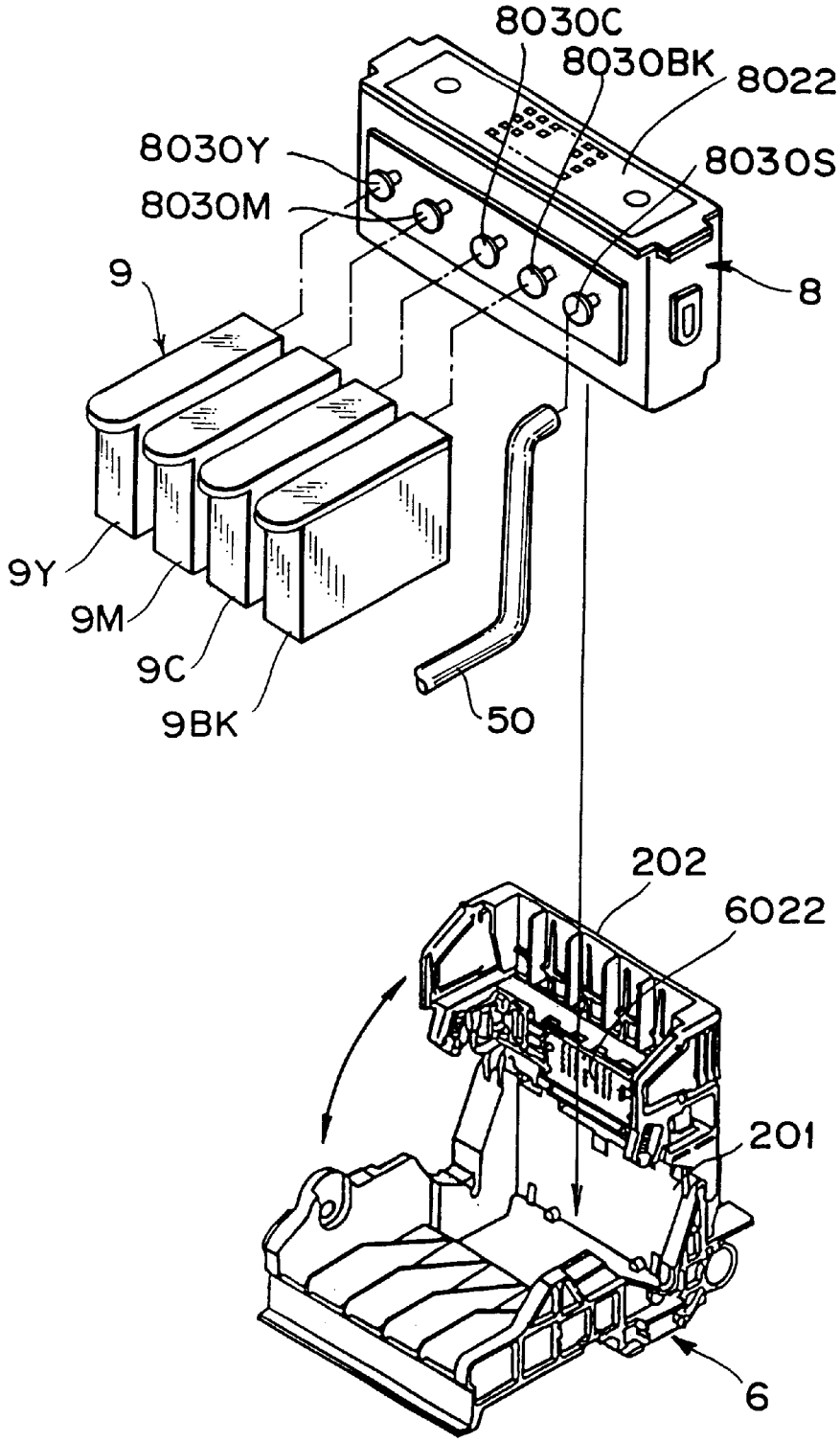
FIG. 9 is an exploded perspective view showing the construction of a carriage of FIG. 8 and the ink jet head unit and ink cartridge mountable on the carriage.
Figure 10:
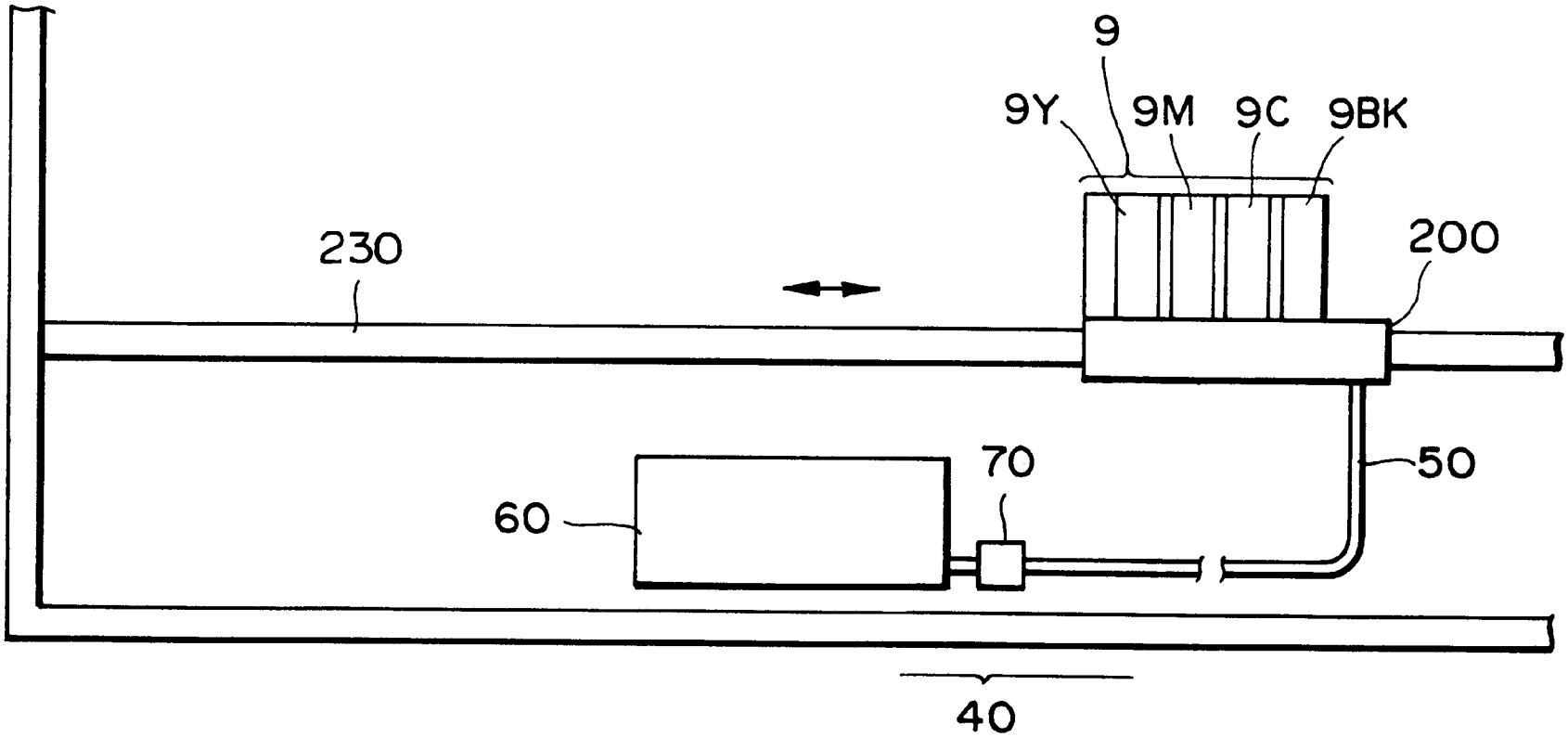
FIG. 10 is a schematic front view showing the ink jet head and a processing liquid supply system in the recording head of FIG. 8.

FIGS. 8 to 10 show another example of the ink jet recording apparatus of this invention. FIG. 8 represents an outline perspective view showing the construction of the recording section. FIG. 9 is an exploded perspective view showing the construction of the carriage and the recording head and ink cartridge mountable on the carriage. FIG. 10 is an outline front view showing the recording section and the processing liquid supply system. Of the constitutional components of the ink jet recording apparatus shown in FIG. 8, the components common to those shown in FIG. 2 are assigned like reference numerals and their description is omitted.

As shown in FIG. 9, an ink jet head unit 8 and color ink cartridges 9 for supplying colored ink to the ink jet head unit 8 can be mounted on a carriage 200. The carriage 200 consists largely of a carriage base 201 for mounting the ink jet head unit 8 and the color ink cartridges 9, and a head lever 202 for holding the ink jet head unit 8 mounted on the carriage base 201.

On the upper surface of the ink jet head unit 8 is provided a connector 8022 that receives signals for driving the recording heads. When the ink jet head unit 8 is mounted on the carriage 200, the connector 8022 is electrically connected to a connector 6022 on the carriage side. The ink jet head unit 8 has four ink supply port 8030 (in FIG. 2, from left to right, yellow 8030Y, magenta 8030M, cyan 8030C and black 8030Bk), one for each color, to supply ink from the color ink cartridges 9 through passages in the heads to respective nozzles. The color ink cartridges 9 are positioned on the carriage 6 in alignment with the ink supply ports 8030 of the heads.

Provided on the side surface of the ink jet head unit 8 in alignment with these ink supply ports 8030 is a processing liquid supply port 8030S for supplying the processing liquid that renders the color ink insoluble. The processing liquid supply port 8030S is connected through a supply tube 50 to a processing liquid tank 60 that forms a part of the processing liquid supply means. The supply tube 50 is long enough so as not to hinder the operation of the carriage 6 during recording. The processing liquid tank 60, as shown in FIG. 10, is installed in the apparatus body 40, not on the carriage 200.

Because securing high print quality requires almost the same number of processing liquid dots as the ink dots that are ejected against the recording medium, the color ink jet recording apparatus requires four times as much volume of processing liquid as each ink cartridge. Suppose, for example, each ink cartridge has an ink capacity of 10 cc. The ink cartridge containing the processing liquid must have a capacity capable of accommodating 40 cc of processing liquid. When the ink cartridge runs out of ink, only the empty color ink cartridge 9 is replaced with a new one.

In this embodiment, the color ink cartridges 9 in the carriage 200 are formed of a translucent container, so that the amount of remaining ink can easily be seen. Because the processing liquid cartridge is accommodated in the apparatus body 40, it can take a sufficient space and thus can stably supply the processing liquid. As shown in FIG. 10, a sensor means 70 such as pressure sensor may be installed in the supply tube 50 to warn the user when the processing liquid in the processing liquid tank 60 runs out. The supply tube 50, the processing liquid tank 60 and the sensor means 70 form the processing liquid supply means.

On both side walls of a roughly U-shaped chassis 400 are mounted a guide shaft 230 and a support shaft 103 for slidably supporting the carriage 200. The driving force for moving the carriage 200 reciprocally in the main scan direction along these shafts is supplied from a carriage motor 250 via a drive belt 220.

The recording medium such as paper (not shown) is held and fed, as shown in FIG. 8, by a platen roller 2 and a pinch roller 3 onto a platen 16. At this time, the nozzles (not shown) of the recording heads mounted on the carriage 200 protrude down from the carriage 200, with the nozzle forming surfaces of the recording heads facing parallel the recording medium on the platen 16.

In this embodiment, a recovery system unit 15 is located at the home position on the right-hand side of the apparatus of FIG. 8 when viewed from the front. When the carriage 200 is at the home position, the recovery system unit 15 caps the recording heads to prevent ink in the nozzles from evaporating, becoming more viscous or sticking to the nozzles and thereby to prevent a failure to eject ink.

When the ink jet head unit 8 should fail, the ink ejecting performance can be recovered by operating a suction and recovery mechanism, which holds suction caps 13 to the recording heads and generates a negative pressure by a pump unit (not shown).

Ink and processing liquid discharged from the pump is recovered to a spent ink tank 401.

The processing liquid tank 60 may take either a replaceable form or a replenishable form. While this embodiment has set the capacity of the processing liquid tank 60 at four times as large as the capacity of the color ink cartridge, this is only a criterion and the tank volume may be greater than four times the cartridge capacity. If permitted spacewise in the apparatus body, the tank volume is preferably more than four times larger than the cartridge capacity because of reduced processing liquid replacements or replenishing frequency.

Figure 11:
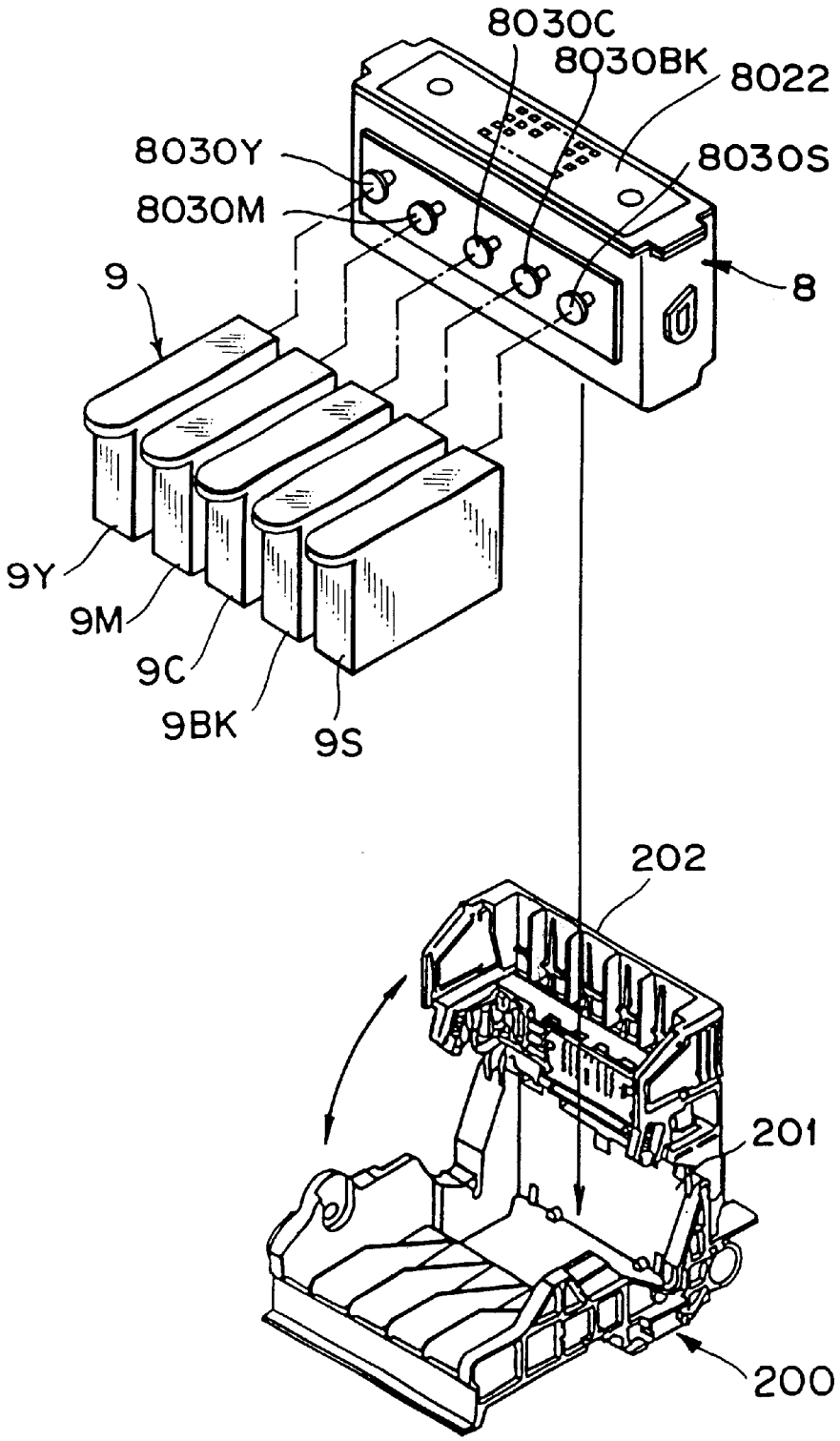
FIG. 11 is an exploded perspective view showing the construction of another example of the carriage and the ink jet head unit and ink cartridge mountable on the carriage in the recording apparatus of this invention.
Figure 12:
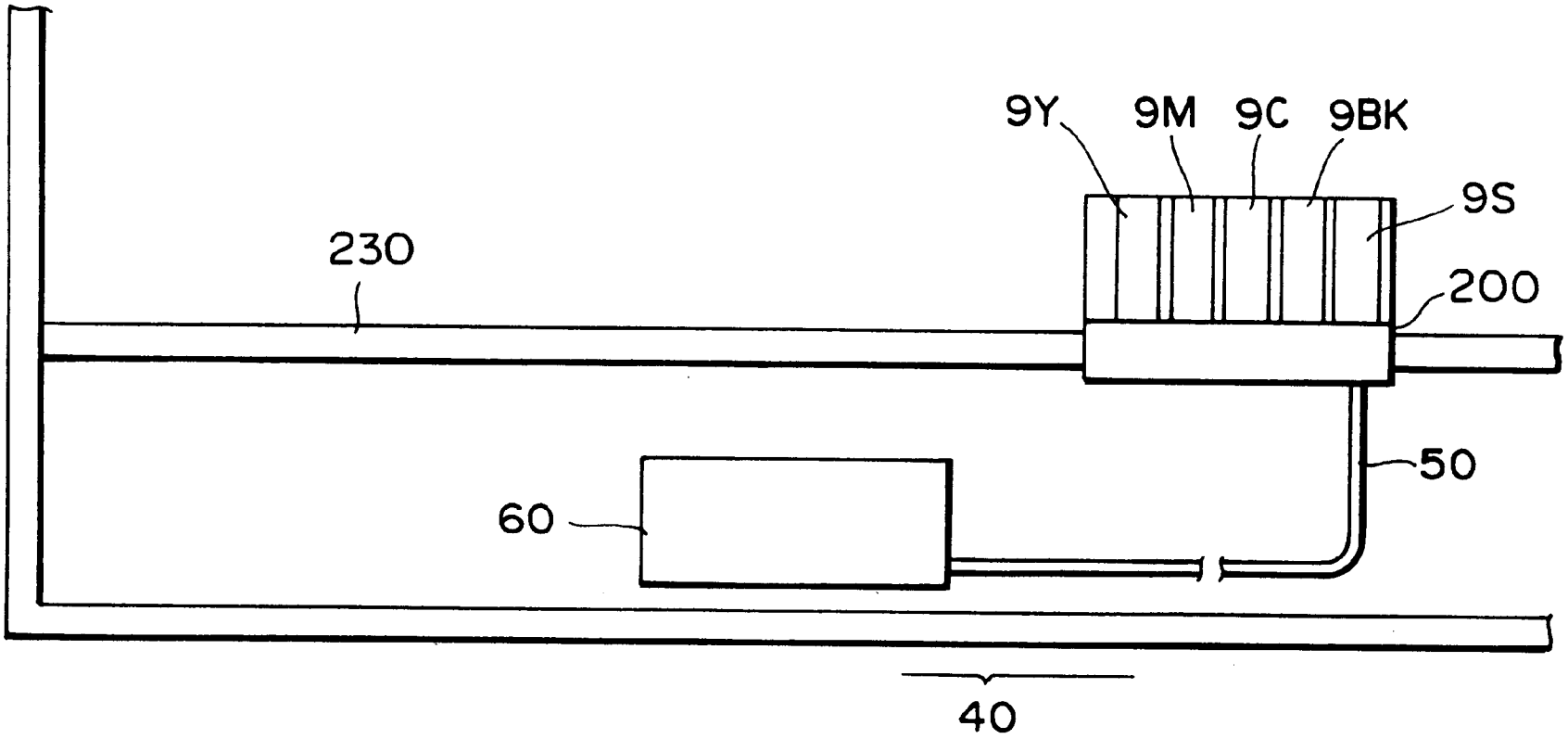
FIG. 12 is a schematic front view showing the ink jet head and a processing liquid replenishing means in the recording head of FIG. 2.

FIGS. 11 and 12 show still another example of the ink jet recording apparatus of this invention. FIG. 11 is an exploded perspective view showing the construction of the carriage and the ink jet head unit and ink cartridges mountable on the carriage. FIG. 12 is an outline front view of the recording section and a processing liquid supply system as the processing liquid supply means. The constitutional components in this embodiment that are identical with those of the preceding embodiments are given like reference numerals and their explanations are omitted.

The feature of this embodiment lies in the fact that, in addition to the processing liquid tank 60 as a main tank, a sub-cartridge 9S containing the processing liquid is used, which is mounted on the carriage 200 in line with the color ink cartridges 9. The processing liquid supply port 8030S of the ink jet head unit 8 is inserted in the sub-cartridge 9S, which is connected to the processing liquid tank 60 through the supply tube 50. Hence, the processing liquid in the main tank 60 is fed through the supply tube 50 and stored temporarily in the sub-cartridge 9S, from which it is supplied to the ink jet head unit 8.

As the amount of liquid remaining in the large-capacity processing liquid tank 60 becomes small, the amount of liquid in the sub-cartridge 9S begins to decrease. If the sub-cartridge 9S is a transparent container, it is easy to determine the time to replace the large-capacity processing liquid tank 60. Further, because checks on the remaining amounts of color ink and processing liquid can be made at the same position on the carriage, it is possible for the user to make a more accurate decision on when the processing liquid tank 60 should be replaced.

Figure 13:
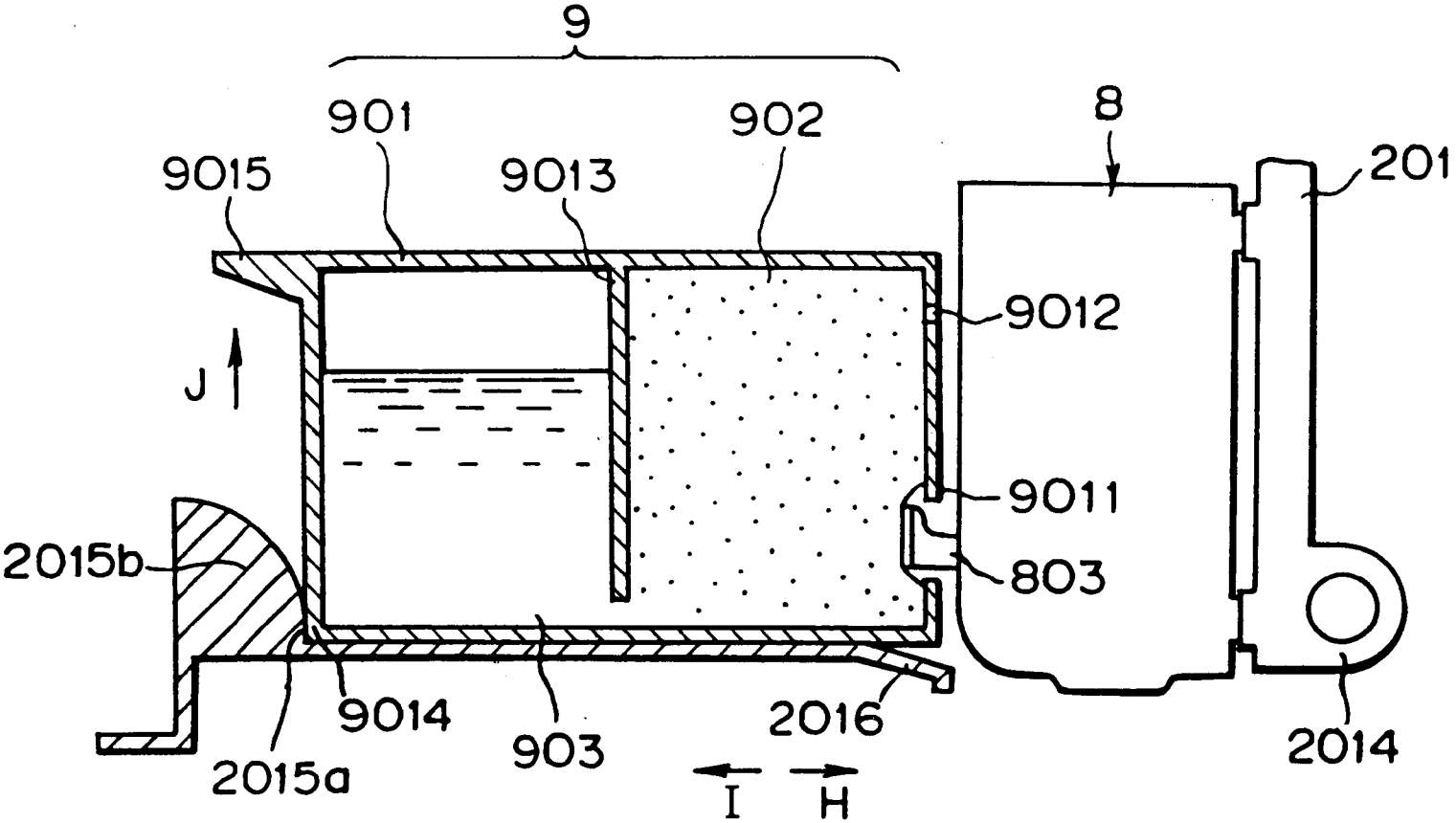
FIG. 13 is a schematic cross sectional view showing the construction for positioning the carriage and the carriage base for the ink jet head unit in the recording apparatus of FIG. 2.

FIG. 13 is a side cross section showing the ink jet head unit 8 and the color ink cartridges 9 mounted on the carriage 200 in this embodiment.

The color ink cartridges 9 are so-called half-raw type ink cartridges, each of which has two compartments therein, a front compartment containing a soaking body 902 and a rear compartment containing raw ink 903. When the color ink cartridges 9 are mounted on the ink jet head unit 8, an ink supply portion 803 of the ink jet head unit 8 pushes and collapses a part of the soaking body 902 in the color ink cartridge 9, pushing the color ink cartridge 9 in the direction of arrow I. The color ink cartridge 9, however, is stopped from moving in the arrow I direction by a stopper 2015*a* on the carriage base 201 and thereby fixed on the carriage base 201. The ink 903 soaked in the soaking body 902 is supplied through the ink supply portion 803 to the ink jet recording head.

The color ink cartridge 9 is guided smoothly along a curved guide portion 2015*b*, quarter-circle-shaped in cross section, of the carriage base 201 and mounted to the ink jet head unit 8. The color ink cartridge 9 can easily be removed by pushing up a handle 9015 in the direction of arrow J. The waste ink from the ink supply portion 803 of the ink jet head unit 8 and from a supply port 9011 of the color ink cartridge 9 is allowed to flow down a waste ink portion 2016 of the carriage base 201 toward the apparatus body 4.

Figure 14:
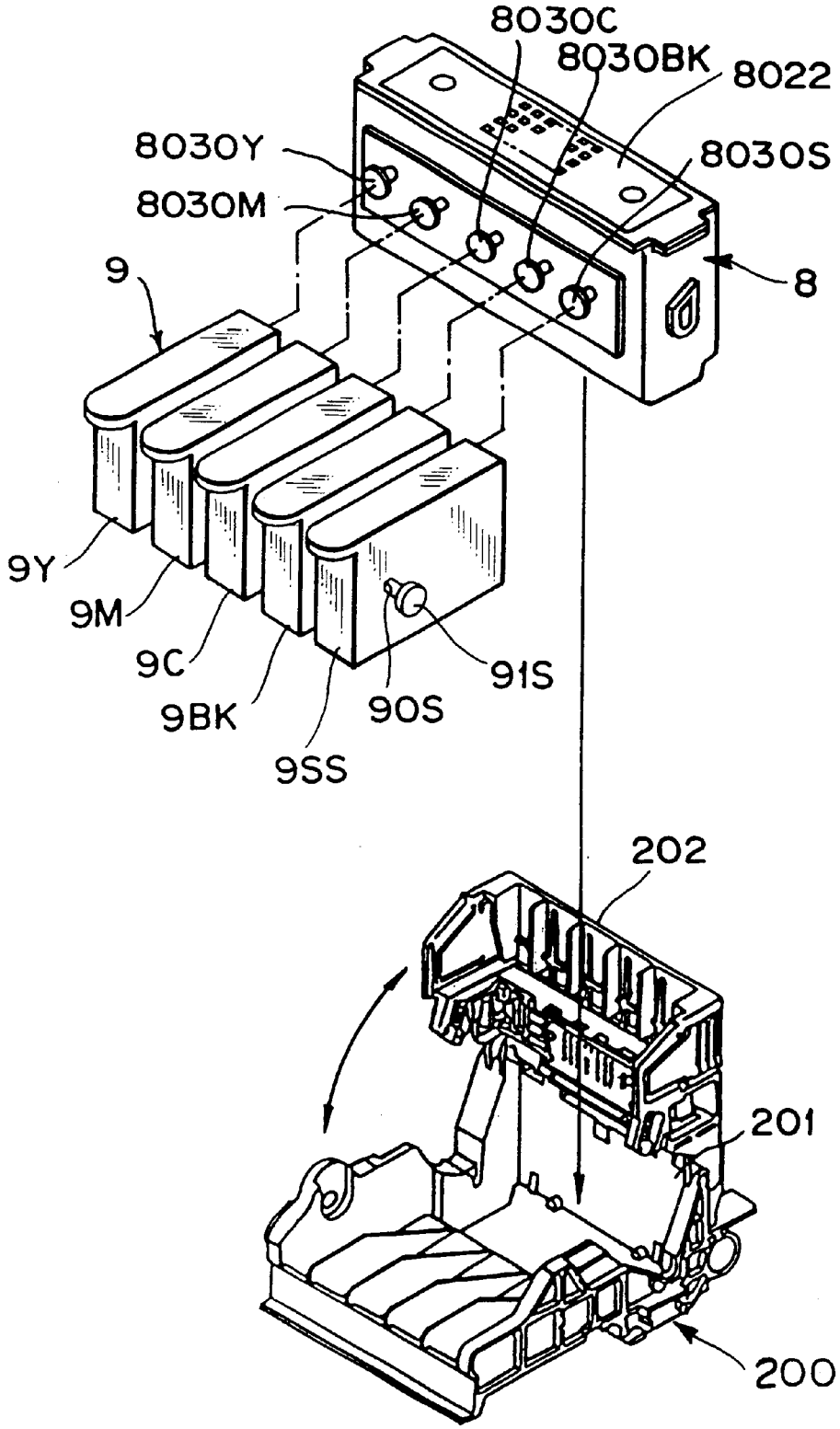
FIG. 14 is an exploded perspective view showing the construction of still another example of the carriage and the ink jet head unit and ink cartridge mountable on the carriage in the recording apparatus of this invention.
Figure 15:
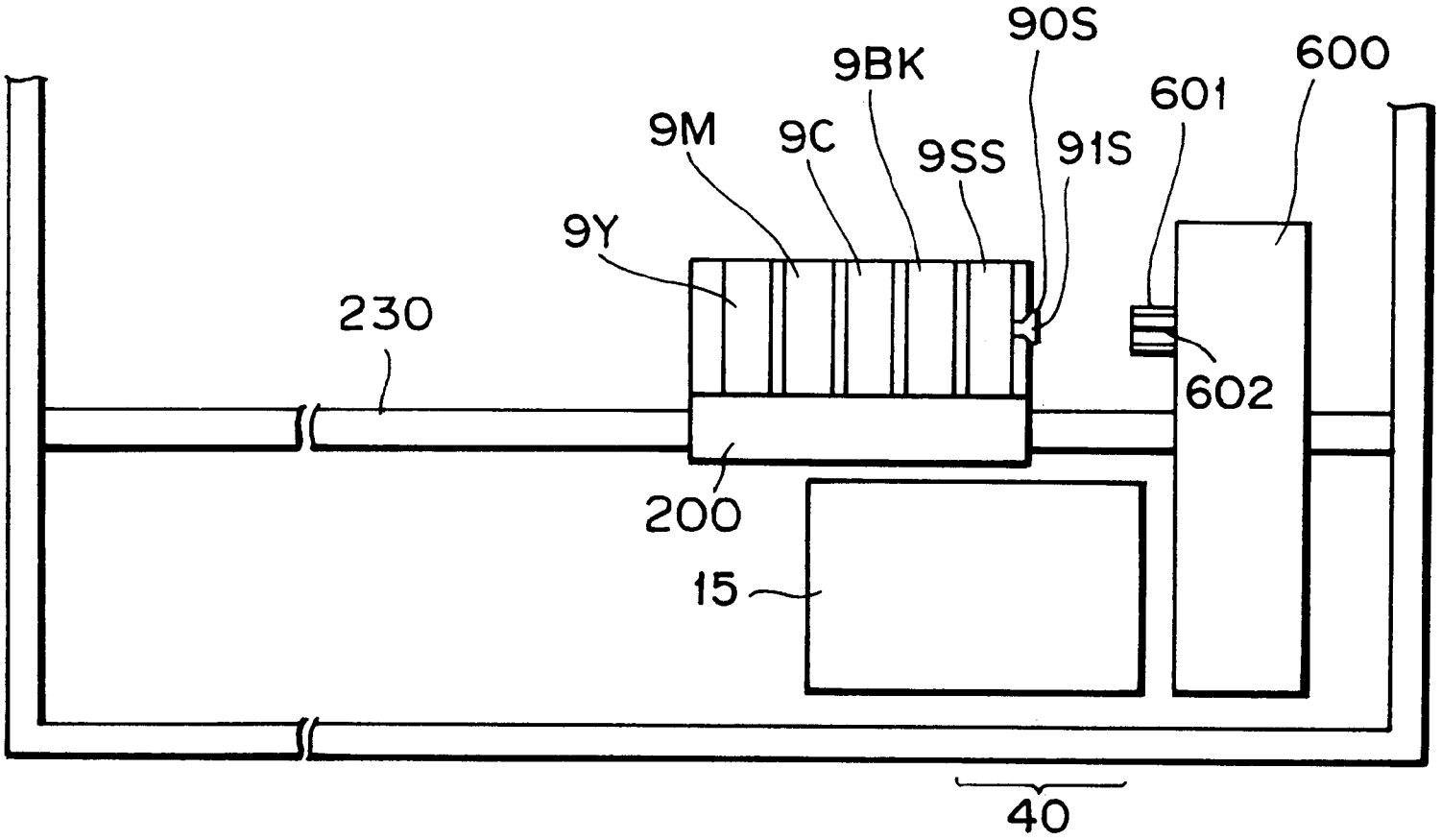
FIG. 15 is a schematic front view showing the ink jet head and the processing liquid replenishing means in the recording apparatus of FIG. 14.
Figure 16:
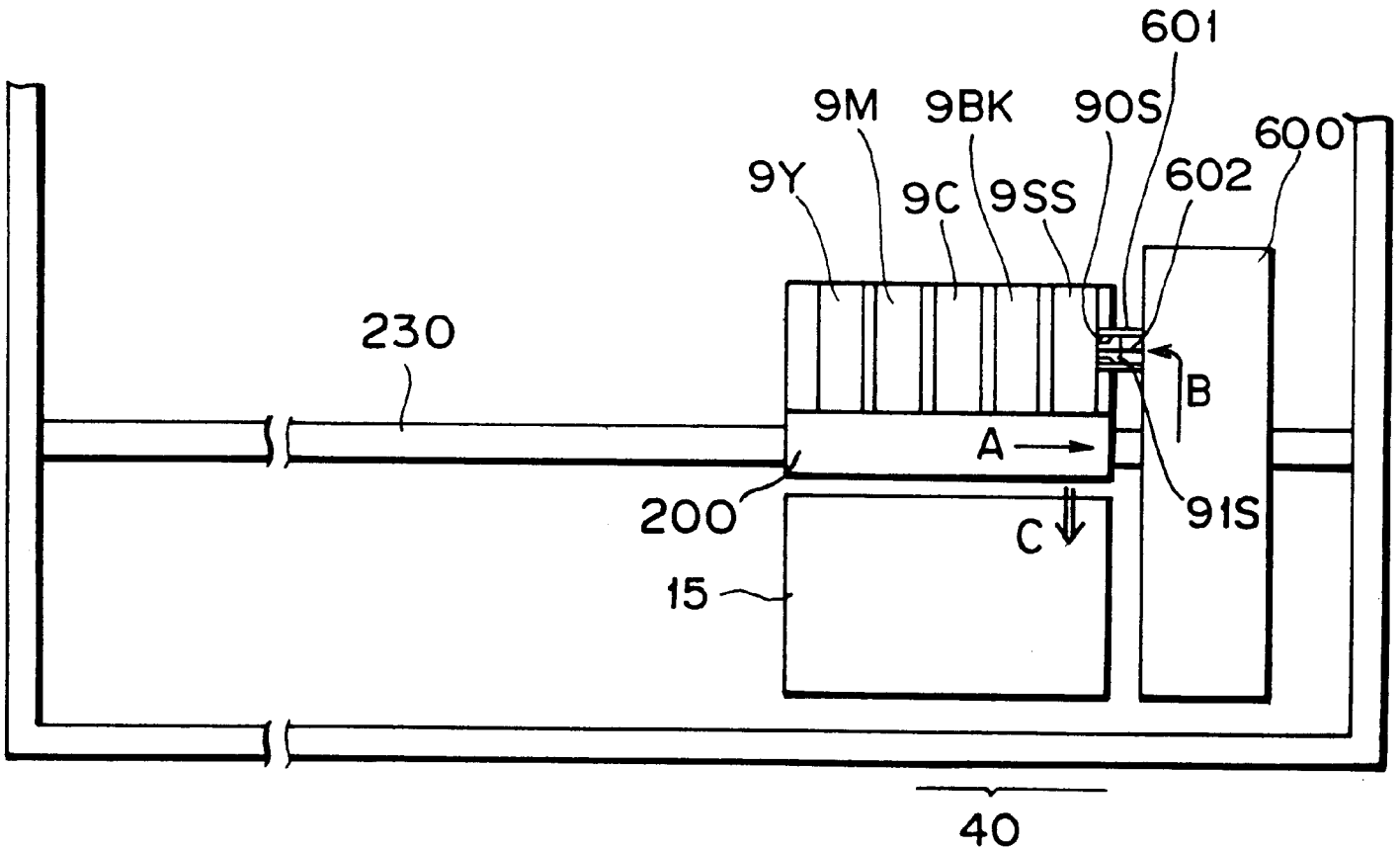
FIG. 16 is a schematic front view showing a processing liquid recovery system in a suction supply state in the recording apparatus of FIG. 14.

FIGS. 14, 15 and 16 represent a third embodiment of the ink jet recording apparatus of this invention. FIG. 14 is an exploded perspective view showing the construction of the carriage and the recording head unit and ink cartridges mountable on the carriage. FIGS. 15 and 16 are outline front views showing the recording section and the processing liquid supply system, with FIG. 15 showing the processing liquid cartridge and the sub-cartridge before being connected and FIG. 16 showing the same but in the connected state. The constitutional components in this embodiment that are identical with those of the preceding embodiments are given like reference numerals and their explanations are omitted.

While the preceding embodiments use the supply tube 50 through which to feed the processing liquid from the processing liquid tank 60 in the apparatus body, this embodiment is characterized in that a sub-cartridge 9SS on the carriage 200 is normally separated from and independent of the processing liquid tank 600 during the recording operation and that only when the supply of processing liquid is needed, the sub-cartridge 9SS is supplied directly from the processing liquid tank 600 without using the tube.

As shown in FIG. 14, the sub-cartridge 9SS is mounted on the carriage 6 in line with the color ink cartridges 9. The side surface of the sub-cartridge 9SS on the home position side is formed with a processing liquid inlet port 90S to receive the processing liquid directly from the processing liquid tank 600. The processing liquid inlet port 90S is fitted with a silicone sealing member 91S to prevent leakage of the processing liquid from the sub-cartridge 9SS.

The large-capacity processing liquid tank 600 is fixed at one end of the guide shaft 230 beyond the home position. The side surface of the processing liquid tank 600 on the carriage 200 side is formed with an ink supply port 601 for supplying the processing liquid to the sub-cartridge 9SS. Inside the ink supply port 601 is provided a needlelike ink supply tube 602.

In FIGS. 15 and 16, the home position is on the right-hand side in the carriage scan direction. As shown in FIG. 15, during printing or home position standby, the sub-cartridge 9SS on the carriage 200 and the large-capacity processing liquid tank 600 are out of contact. When the processing liquid in the sub-cartridge 9SS reduces and a need arises to supply the processing liquid to the sub-cartridge 9SS from the processing liquid tank 600, the carriage 200 is moved further to the right beyond the home position (in the direction of arrow A) as shown in FIG. 16 to connect the inlet port 90S and the supply port 601 piercing the ink supply tube 602 through the silicone member 91S. At the same time, the recovery system unit 15 is operated to perform suction C and produce a negative pressure in the sub-cartridge 9SS, thus causing the processing liquid in the processing liquid tank 600 to flow in the direction of arrow B into the sub-cartridge 9SS.

Figure 17:
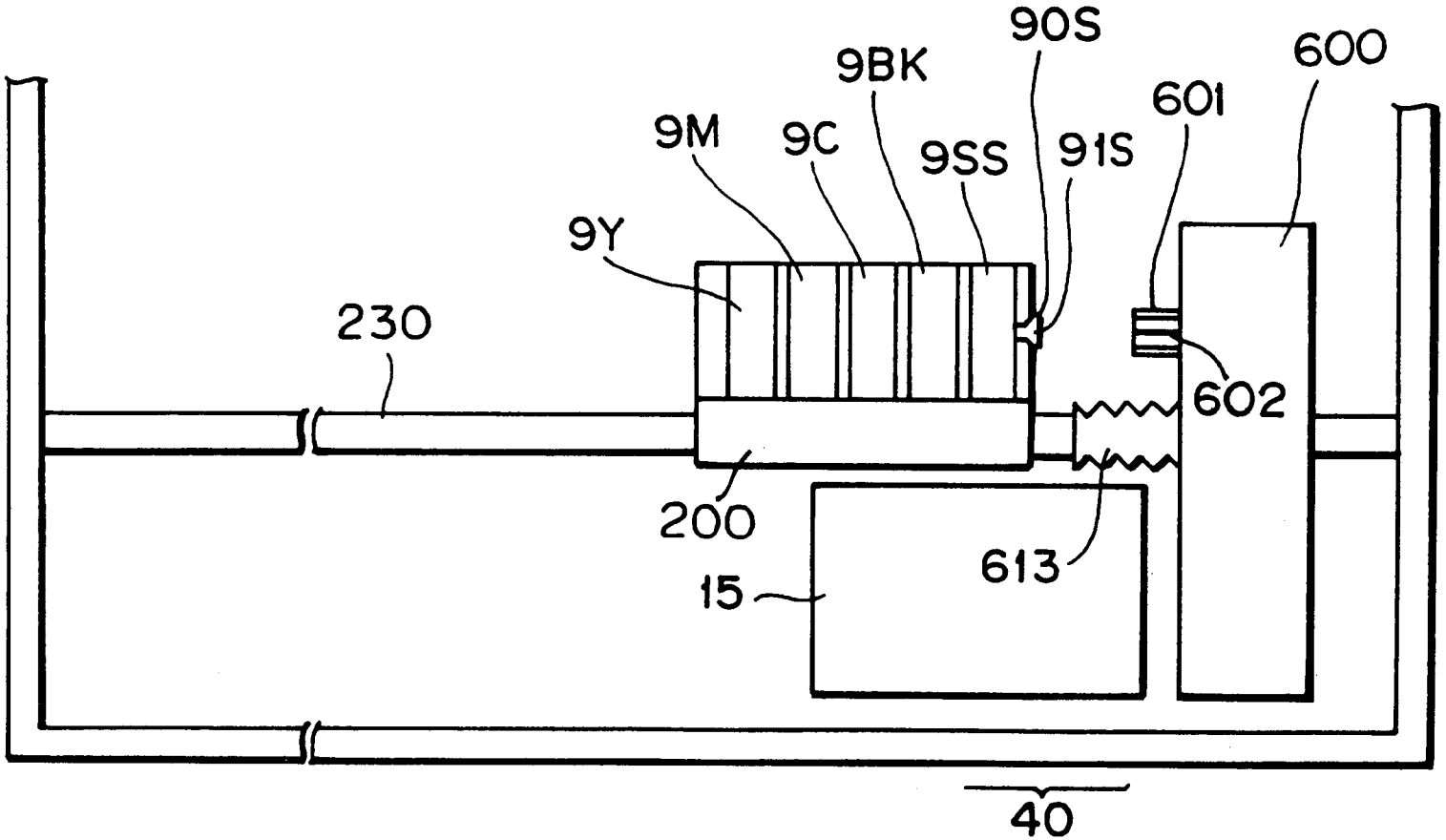
FIG. 17 is a schematic front view showing a variation of the processing liquid replenishing means of FIG. 15.
Figure 18:
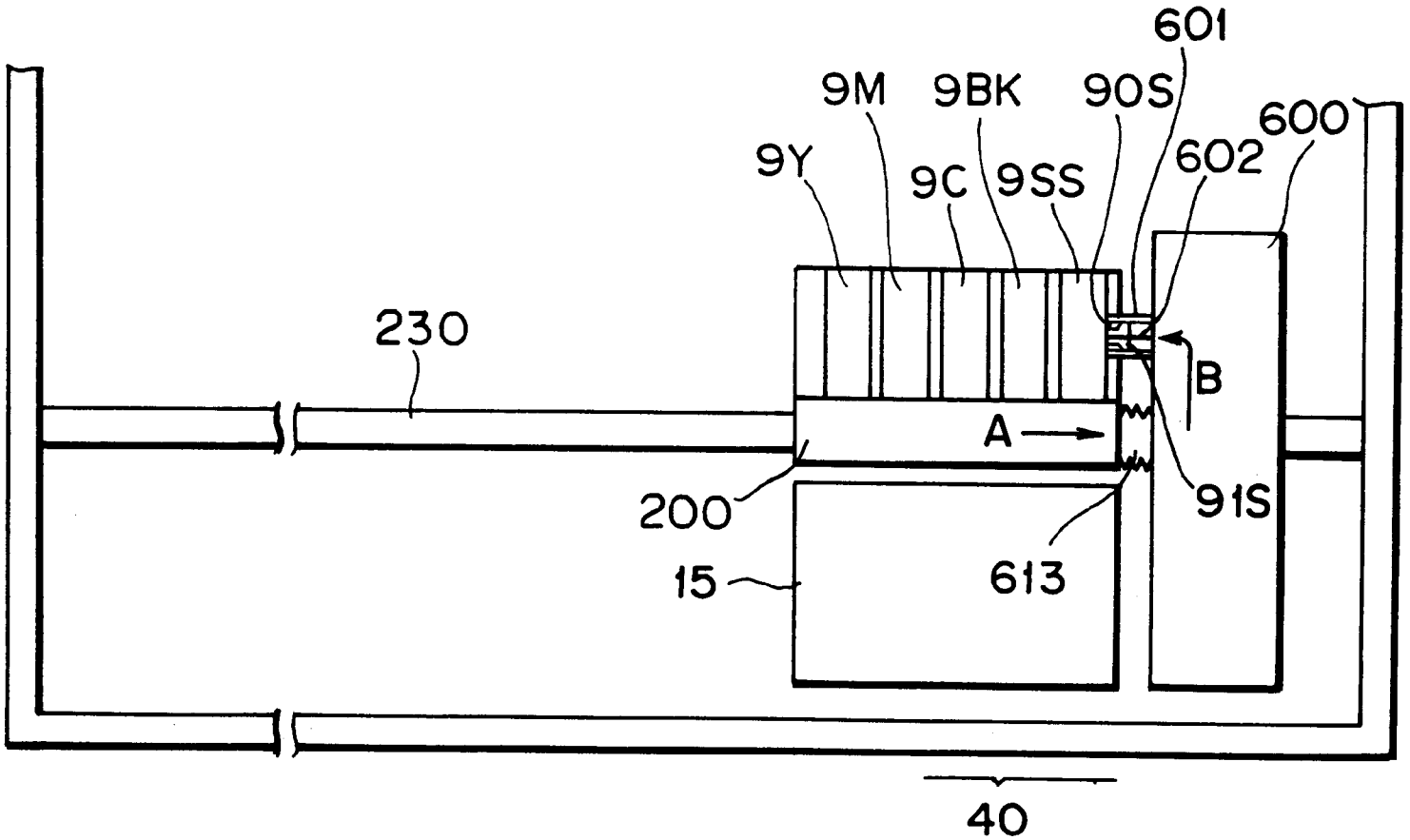
FIG. 18 is a schematic front view showing the processing liquid replenishing means of FIG. 17 in a pressurized supply state.

While this embodiment uses a negative pressure produced by suction of the recovery system unit 15 in supplying the processing liquid from the processing liquid tank 600 to the sub-cartridge 9SS, it is possible to use a pump 613 that pressurizes the interior of the processing liquid tank 600 by utilizing the driving force of the carriage 200 in a particular direction, as shown in FIGS. 17 and 18. The pressurizing pump 613 is provided at the side surface of the processing liquid tank 600. As shown in FIG. 17, during the normal recording, the carriage 6 is isolated from the pressurizing pump 613 and, during the processing liquid supply, pushes the bellows of the pressurizing pump 613 to pressurize the interior of the processing liquid tank 600 with the inlet port 90S and the supply port 601 connected together, causing the processing liquid to flow in the direction of arrow B into the sub-cartridge 9SS on the carriage 6.

Figure 19:
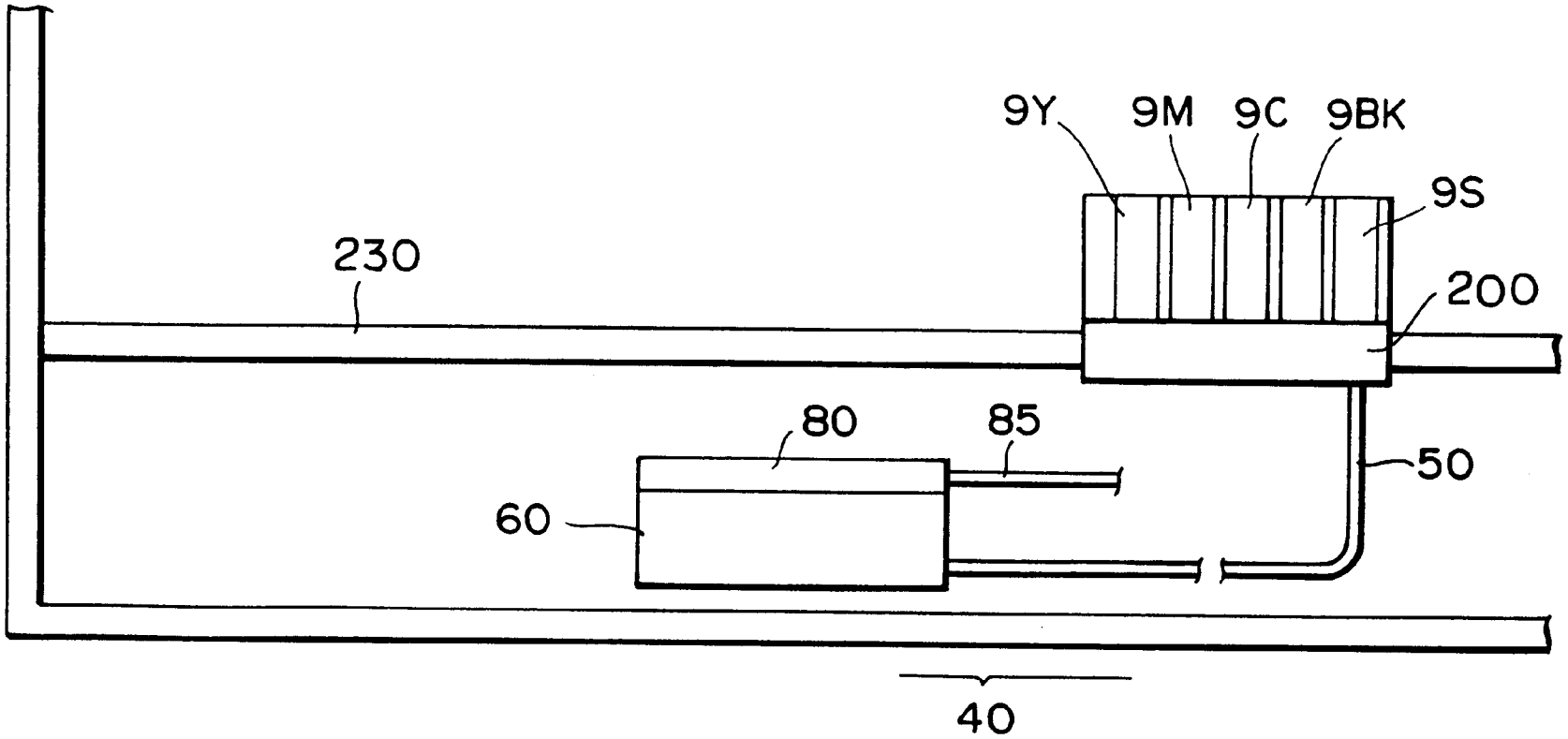
FIG. 19 is a schematic front view showing the construction of a further example of the processing liquid replenishing means and a spent ink processing system in the recording apparatus of this invention.

FIG. 19 is an outline front view showing the construction of the processing liquid supply system as the processing liquid supply means and of the waste ink processing system in still another example of the ink jet recording apparatus according to this invention.

In the preceding embodiments, the waste ink is recovered to a waste liquid tank 401 in the apparatus body 40 containing a porous soaking body. The feature of this embodiment, as shown in FIG. 19, is that a porous soaking body 80 is installed in a part of the processing liquid tank 60 to soak the waste ink. The processing liquid tank 60, of course, has a partition wall therein that completely separates the processing liquid compartment and the waste ink compartment. The waste liquid may be either color ink or processing liquid. When waste color ink is to be absorbed by the soaking body 80, the waste processing liquid may be accommodated in the waste liquid tank on the apparatus body 40 side so as to increase the amount of waste ink accommodating or absorbing capacity.

As described above, in the ink jet recording apparatus of this invention that forms an image by ejecting the processing liquid and the ink against the recording medium, a processing-liquid-dedicated tank has a capacity equal to or larger than the capacity of the color ink tank, and is installed in the apparatus body and so constructed as to allow the operator to easily recognize the necessity for replacing the processing liquid tank. This makes it possible to provide a highly reliable ink jet recording apparatus that can secure a sufficient amount of processing liquid for improving the image quality.

The present invention has been described in detail with respect to preferred embodiments, and it should now be understood that changes and modifications may be made without departing from the invention in its broader aspects and that the appended claims of the invention cover all such changes and modifications as fall within the true spirit of the invention.

What is claimed is:

1. An ink jet recording method of recording on a recording medium by using an ink including a coloring material, and a processing liquid that coagulates the coloring material or makes the coloring material insoluble, the method comprising the steps of:

arranging, on a carriage of an ink jet printer, a first accommodating portion to accommodate the ink and a second accommodating portion to accommodate the processing liquid; and replenishing the ink in the first accommodating portion in a way different from replenishing of the processing liquid in the second accommodating portion.

2. A method as claimed in claim 1, further comprising the step of ejecting the ink and the processing liquid from respective first and second liquid jet heads onto the recording medium, wherein the processing liquid is ejected from the second liquid jet head prior to the ejection of the ink from the first ink jet head.

3. A method as claimed in claim 1, wherein the ink contains anionic dye.

4. A method as claimed in claim 1, wherein the ink contains at least anionic compound and pigment.

5. A method as claimed in claim 1, wherein the processing liquid contains a cation substance.

6. A method according to claim 1, wherein the first accommodating portion and the second accommodating portion accommodate substantially the same amount of ink and processing liquid, respectively.

7. A method according to claim 1, wherein replenishing the ink in the first accommodating portion comprises replacing the first accommodating portion, and wherein replenishing the processing liquid in the second accommodating portion comprises supplying processing liquid from a processing liquid retaining portion to the second accommodating portion.

8. A method according to claim 7, wherein the processing liquid retaining portion is accommodated at an end of a lateral movement extent of the carriage and the processing liquid is supplied to the second accommodating portion by movement of the carriage to engage the second accommodating portion with the processing liquid retaining portion.

9. A method according to claim 1, wherein the processing liquid accommodated in the second accommodating portion and the processing liquid retaining portion is substantially equal to or greater than an amount ink accommodated in the first accommodating portion.

10. An ink jet recording apparatus of recording on a recording medium by using an ink including a coloring material, and a processing liquid that coagulates the coloring material or makes the coloring material insoluble, the apparatus comprising:

a carriage reciprocally moving along a recording surface of the recording medium, said carriage having a first ink jet head for ejecting the ink and a second ink jet head for ejecting the processing liquid, the first and second ink jet heads being retained on said carriage so that the first and second ink jet heads are opposed to the recording surface of the recording medium, and so that the first and second ink jet heads are arranged in line with each other, and said carriage retaining a first accommodating portion that accommodates the ink and a second accommodating portion that accommodates the processing liquid, the second accommodating portion being arranged at an end of said carriage in a direction of the reciprocal movement of said carriage;

a processing liquid retaining portion arranged at an end of a region defined by the reciprocal movement of said carriage, said processing liquid retaining portion for retaining the processing liquid which is to be supplied to the second accommodating portion; and a communication mechanism for communicating said processing liquid retaining portion with the second accommodating portion when said carriage is moved to an end of the region defined by the reciprocal movement of said carriage, wherein the processing liquid is supplied to the second accommodating portion from the processing liquid retaining portion to replenish the processing liquid in the second accommodating portion in a way different from replenishing of the ink in the first accommodating portion.

11. An apparatus as claimed in claim 10, wherein the first and second heads are arranged in the order of the second and the first heads in a direction which said carriage is moved to perform forming an image on the recording medium.

12. An apparatus as claimed in claim 10, wherein the first and second heads are integrated to form an ink jet head unit.

13. An apparatus as claimed in claim 12, wherein said ink jet head unit is removably mounted on said carriage.

14. An apparatus as claimed in claim 12, wherein said first and second accommodating portions are removably arranged on said ink jet head unit.

15. An apparatus as claimed in claim 10, wherein said processing liquid retaining portion is connected with said second accommodating portion to supply the processing liquid to said second accommodating portion, only when said carriage is moved to the end position.

16. An apparatus as claimed in claim 15, wherein said processing liquid retaining portion further comprises a pressurizing pump for supplying the processing liquid to said second accommodating portion by using a force generated by the movement of said carriage.

17. An apparatus as claimed in claim 16, wherein said pressuring pump further comprises bellows for pressurizing an interior of said processing liquid retaining portion when aid second accommodating portion is connected to said processing liquid retaining portion.

18. An apparatus as claimed in claim 10, wherein at least one of the first ink jet head and the second ink jet head has an electro-thermal conversion body of generating thermal energy for ejecting the ink, as an energy generating element of generating energy which is used to eject the ink.

19. An apparatus as claimed in claim 10, wherein said first accommodating portion is divided into a first portion and a second portion communicating to the first portion through a fine hole, the first portion including an absorbing portion of absorbing the ink, and the second portion for accommodating the ink.

20. An apparatus as claimed in claim 10, wherein said first accommodating portion is divided according to a kind of the coloring material in the ink.

21. An apparatus as claimed in claim 10, wherein said first accommodating portion is divided according to a density of the ink.

22. An apparatus according to claim 10, wherein the ink is replenished in the first accommodating portion by replacing the first accommodating portion.

23. An apparatus according to claim 10, wherein the first accommodating portion and the second accommodating portion accommodate substantially the same amount of ink and processing liquid, respectively.

24. An apparatus according to claim 10, wherein the second accommodating portion and the processing liquid retaining portion retain an amount of processing liquid substantially equal to or greater than an amount of ink accommodated by the first accommodating portion.

25. An ink jet recording method of an ink jet recording apparatus for recording on a recording medium, said ink jet recording apparatus having a carriage which moves reciprocally across the recording medium and which retains a plurality of ejection heads for ejecting to the recording medium an ink that includes a coloring material and a processing liquid that coagulates the coloring material or makes the coloring material insoluble, the method comprising the steps of:

arranging in the carriage a first accommodating portion to accommodate the ink and a second accommodating portion to accommodate the processing liquid;

arranging a processing liquid retaining portion for retaining the processing liquid that is to be supplied to the second accommodating portion at an end of a region defined by the reciprocal movement of said carriage; and supplying the processing liquid from the processing liquid retaining portion to the second accommodating portion by moving the carriage to a predetermined position so as to form a liquid supply passage between the processing liquid retaining portion and the second accommodating portion, wherein the supplying of the processing liquid replenishes the processing liquid in the second accommodating portion in a way different from replenishing of the ink in the first accommodating portion.

26. A method as claimed in claim 25, further comprising the step of ejecting the ink and the processing liquid from respective first and second liquid jet heads onto the recording medium, wherein the processing liquid is ejected from the second liquid jet head prior to the ejection of the ink from the first ink jet head.

27. A method as claimed in claim 25, wherein the ink contains anionic dye.

28. A method as claimed in claim 25, wherein the ink contains at least anionic compound and pigment.

29. A method as claimed in claim 25, wherein the processing liquid contains a cation substance.

30. A method according to claim 25, wherein the ink is replenished in the first accommodating portion by replacing the first accommodating portion.

31. A method according to claim 25, wherein the first accommodating portion and the second accommodating portion accommodate substantially the same amount of ink and processing liquid, respectively.

32. A method according to claim 25, wherein the second accommodating portion and the processing liquid retaining portion retain an amount of processing liquid substantially equal to or greater than an amount of ink accommodated by the first accommodating portion.

* * * * *

UNITED STATES PATENT AND TRADEMARK OFFICE

CERTIFICATE OF CORRECTION

PATENT NO. : 6,350,022 B1
DATED : February 26, 2002
INVENTOR(S) : Takemura et al.

It is certified that error appears in the above-identified patent and that said Letters Patent is hereby corrected as shown below:

Title page,
Item [56], References Cited, FOREIGN PATENT DOCUMENTS,

| | | | | |
|---|---|---|---|---|
| "JP | 61249755" | should read | -- JP | 61-249755 -- |
| "JP | 63315284" | should read | -- JP | 63-315284 -- |
| "JP | 01063185" | should read | -- JP | 64-63185 -- |
| "JP | 02039213" | should read | -- JP | 2-39213 --. |

Column 3,
Line 19, "a" (second occurrence) should read -- an --.

Column 4,
Line 61, "cross sectional" should read -- cross-sectional --.

Column 5,
Line 14, "cross sectional" should read -- cross-sectional --.

Column 8,
Line 41, "an" should be deleted;
Line 48, "water-resistant" should read -- water-resistance --;
Line 60, "but." should read -- but --; and
Line 63, "followings" should read -- following --.

Column 9,
Line 11, "that" should read -- in --; and

UNITED STATES PATENT AND TRADEMARK OFFICE

CERTIFICATE OF CORRECTION

PATENT NO. : 6,350,022 B1
DATED : February 26, 2002
INVENTOR(S) : Takemura et al.

It is certified that error appears in the above-identified patent and that said Letters Patent is hereby corrected as shown below:

Column 18,
Line 39, “ink” should read -- of ink --.

Column 19,
Line 34, “aid” should read -- said --.

Signed and Sealed this

Twenty-seventh Day of May, 2003

JAMES E. ROGAN
*Director of the United States Patent and Trademark Office*